US007191477B2

(12) United States Patent
Hahn et al.

(10) Patent No.: US 7,191,477 B2
(45) Date of Patent: Mar. 20, 2007

(54) MEDICAL ASSIST DEVICE

(75) Inventors: J. Roland Hahn, Findlay, OH (US); Janet E. Gohlke, Boise, ID (US); William P. Camp, Jr., Vanlue, OH (US); Shelby J. Buell, Lakewood, OH (US); Ronald Rich, Burton, OH (US)

(73) Assignee: Pivot Assist LLC, Findlay, OH (US)

( * ) Notice: Subject to any disclaimer, the term of this patent is extended or adjusted under 35 U.S.C. 154(b) by 170 days.

(21) Appl. No.: 10/899,980

(22) Filed: Jul. 27, 2004

(65) Prior Publication Data

US 2005/0060801 A1 Mar. 24, 2005

Related U.S. Application Data

(63) Continuation-in-part of application No. 10/742,736, filed on Dec. 18, 2003.

(60) Provisional application No. 60/503,984, filed on Sep. 19, 2003.

(51) Int. Cl.
*A61G 7/10* (2006.01)

(52) U.S. Cl. ..... 5/81.1 RP; 5/81.1 R

(58) Field of Classification Search ..... 5/81.1 RP, 5/81.1 R, 86.1; 280/250.1, 304.1
See application file for complete search history.

(56) References Cited

U.S. PATENT DOCUMENTS

| | | | | |
|---|---|---|---|---|
| 2,757,388 A | | 8/1956 | Chisholm | |
| 2,779,642 A | | 1/1957 | Matthews | |
| 2,975,435 A | | 3/1961 | Forrest | |
| 3,100,639 A | | 8/1963 | Bonewitz | |
| 3,455,531 A | | 7/1969 | Baker | |
| 3,911,509 A | | 10/1975 | Fleckenstein | |
| 4,026,279 A | | 5/1977 | Simjian | |
| 4,279,043 A | * | 7/1981 | Saunders | 5/81.1 RP |
| D267,513 S | | 1/1983 | Weigel et al. | |
| 4,753,173 A | | 6/1988 | James | |
| 4,852,193 A | * | 8/1989 | Alsip et al. | 5/607 |
| 4,856,128 A | * | 8/1989 | Alsip et al. | 5/607 |
| 4,866,796 A | * | 9/1989 | Robinson et al. | 5/607 |
| 4,920,589 A | * | 5/1990 | LaVelle et al. | 5/607 |
| 4,924,537 A | * | 5/1990 | Alsip et al. | 5/608 |
| 4,934,003 A | | 6/1990 | Hayakawa et al. | |
| 4,944,054 A | * | 7/1990 | Bossert | 5/609 |
| 5,000,513 A | | 3/1991 | Schmidt | |

(Continued)

OTHER PUBLICATIONS

Page 7 of the McMaster-Carr Supply Brochure.

*Primary Examiner*—Robert G. Santos
(74) *Attorney, Agent, or Firm*—Emch, Schaffer, Schaub & Porcello Co., L.P.A.

(57) ABSTRACT

A medical assist device relocates patients from a first support such as a bed to a second support such as a chair or wheelchair. Upon location of the assist device to a position adjacent such first support, the patient may stand on a rotatable platform of the assist device. Upon actuation of the motor, preferably by a remote controller, the platform is caused to slowly rotate through a desired angular path to position the patient adjacent the second support. A steadying structure is provided for gripping by the patient. Under one embodiment, the steadying structure is designed to be collapsible. Mounted on a frame with the rotatable platform is a seat and wheels for moving a patient across a room or from room to room.

10 Claims, 26 Drawing Sheets

U.S. PATENT DOCUMENTS 5,054,137 A 10/1991 Christensen
5,079,789 A 1/1992 Jandrakovic
5,152,024 A * 10/1992 Chrones et al. ..... 5/609
5,282,284 A 2/1994 Brantman et al.
5,311,622 A 5/1994 Allen
D351,026 S 9/1994 Madera
5,381,569 A 1/1995 Church
5,507,044 A 4/1996 Williamson et al.
5,524,303 A * 6/1996 Palmer et al. ..... 5/81.1 RP
5,564,788 A 10/1996 Warhaftig
D390,958 S 2/1998 Lathrop
5,735,002 A 4/1998 Kistner
5,788,618 A 8/1998 Joutras
6,378,148 B1 4/2002 Votel
6,496,991 B1 12/2002 Votel
6,568,646 B2 5/2003 Wess et al.
2005/0060801 A1* 3/2005 Hahn et al. ..... 5/81.1 R
2005/0076436 A1* 4/2005 Hahn et al. ..... 5/81.1 R

* cited by examiner

MEDICAL ASSIST DEVICE

CROSS REFERENCE TO RELATED APPLICATIONS

This application is a continuation-in-part of application Ser. No. 10/742,736 filed Dec. 18, 2003 and is based on and claims the benefit of U.S. Provisional Patent Application No. 60/503,984 filed Sep. 19, 2003.

BACKGROUND OF THE INVENTION

The present invention is generally directed to a medical assist device for assisting in the transfer of an infirmed patient from a bed to a chair or chair to a wheelchair or back to a bed or from a wheelchair to a toilet or bathtub. A number of patient or invalid transfer apparati have been disclosed in the prior art, including those disclosed in the following U.S. Pat. Nos. 2,757,388; 2,975,435; 3,911,507; 5,054,137 and 5,079,789, the disclosures of which are incorporated herewith by reference. Typically, the prior art devices utilized a rotatable platform upon which the patient could stand and a support handle which the patient could grip. It is believed that the prior art devices have not found widespread acceptance for one reason or another.

Accordingly, it is an object of the present invention to provide a new, easily usable apparatus for rotationally transferring a patient from one support such as a bed, chair or wheelchair to another of such supports.

It is a further object of the present invention to provide a motor driven apparatus for transferring a patient which, for the very infirmed, cannot be activated by the patient but only by an attendant, preferably through use of a controller which is remote from the patient support platform. For patients who are less infirmed, the medical assist device could be equipped with controls which the patient could operate while standing thereon.

It is another object of the present invention to provide apparatus with (1) a rotatable platform for rotatably shifting a patient positioned thereon, (2) a seat adjacent said rotatable platform and (3) wheels for moving a patient distances further than permitted by rotation of the platform.

Other objects and advantages of the present invention will become readily apparent to those skilled in the art upon a review of the detailed description of the preferred embodiment and the accompanying drawings.

SUMMARY OF THE INVENTION

Under the present invention there is provided a medical assist device having a motor powered rotatable platform upon which a patient may stand while being rotated from one support such as a bed to another support such as a chair or wheelchair. Steadying members for gripping by the patient extend upwardly from the rotatable platform to provide auxiliary supporting means for the patient as he/she is rotated from a position of alignment with one support to a position of alignment with a second support. Under one embodiment, the rotatable platform is power driven through the use of a twin disk mechanism in which a first disk, rotated directly by a motor, engages and rotates a rotatable disk associated with and rotatable with the platform upon which the patient is standing. Means are provided to urge the outer peripheral edge of the rotatable platform into tight frictional engagement with the circumferential edge of the motor driven first disk as that portion of the rotatable platform is displaced downwardly by the weight of a patient standing thereon.

Under other embodiments, the rotatable platform may be powered by various types of gears or by belts and pulleys. The assist device is waterproof and readily cleanable with water or other liquids without damaging the motor or other operating mechanism. The assist device is provided with a pair of caster wheels engagable with the floor upon tilting thereof to permit ready movement to a position to receive the patient. The motor may be actuated by remote control and does not require a switch to be mounted on the device itself; however, it is within the contemplation of this invention that an actuation switch could be mounted on the assist device. The extent of rotation may be controlled by the actuating mechanism to stop at any desired angular movement between 0° and 360° to the left and 360° to the right.

Under a further embodiment, the steadying members mounted on the rotatable platform for gripping by the patient are designed such that opposing side members may be folded toward the end member connected thereto and the thus folded side members and end members pivoted about pivot connectors secured to the rotatable platform. This permits the device to be readily collapsed for storage or transportation to another site while insuring that the steadying members at all times remain with the rotatable platform. This feature of the invention is useable with a non-powered as well as a powered rotatable platform.

Under a further embodiment, the rotatable platform is mounted on a frame having wheels and a seat on which the patient can sit while the apparatus is pushed across the room or from room to room.

DETAILED DESCRIPTION OF THE PREFERRED EMBODIMENTS

Figure 1:
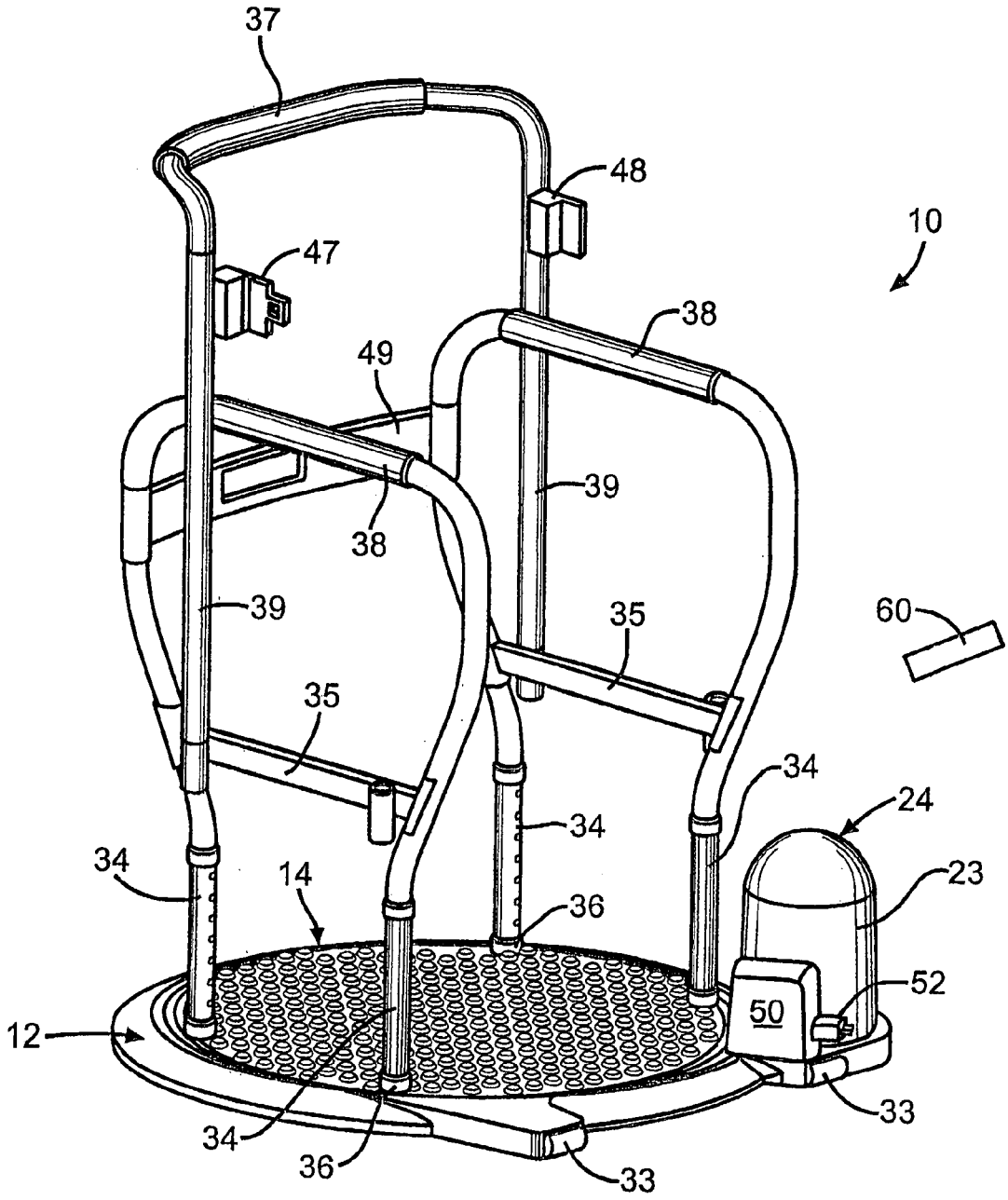
FIG. 1 is a perspective view of the medical assist device of the present invention.

Referring to the drawings there is shown the medical assist device 10 of the present invention including a base 12 on which is mounted a rotatable platform 14 on which a patient being relocated from one support to a second support may stand. The rotatable platform 14 rotates about a first axis A—A and includes a rotatable disk 18 to which is adhered a pad 16 formed of rubber or other suitable material which will minimize the risk of the patient slipping thereon and which may have a series of protuberances 17 to provide additional anti-slip means. The platform 14, including its rotatable disk 18, is rotatable relative to the base 12.

Figure 6:
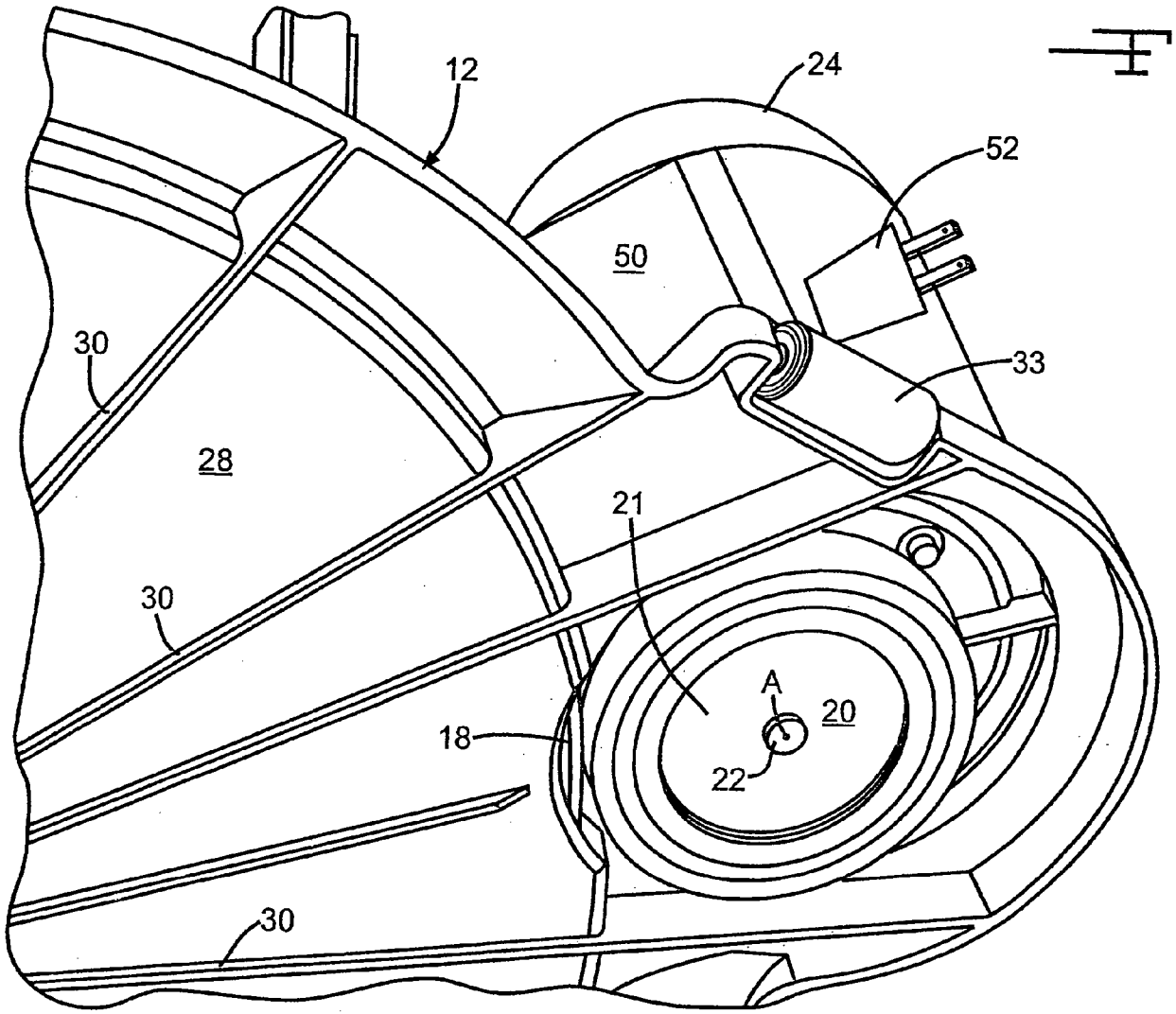
FIG. 6 is an enlarged fragmentary perspective view taken from the bottom showing the motor power driven disk engaged to the rotatable disk to which the rotatable support platform is mounted.
Figure 7:
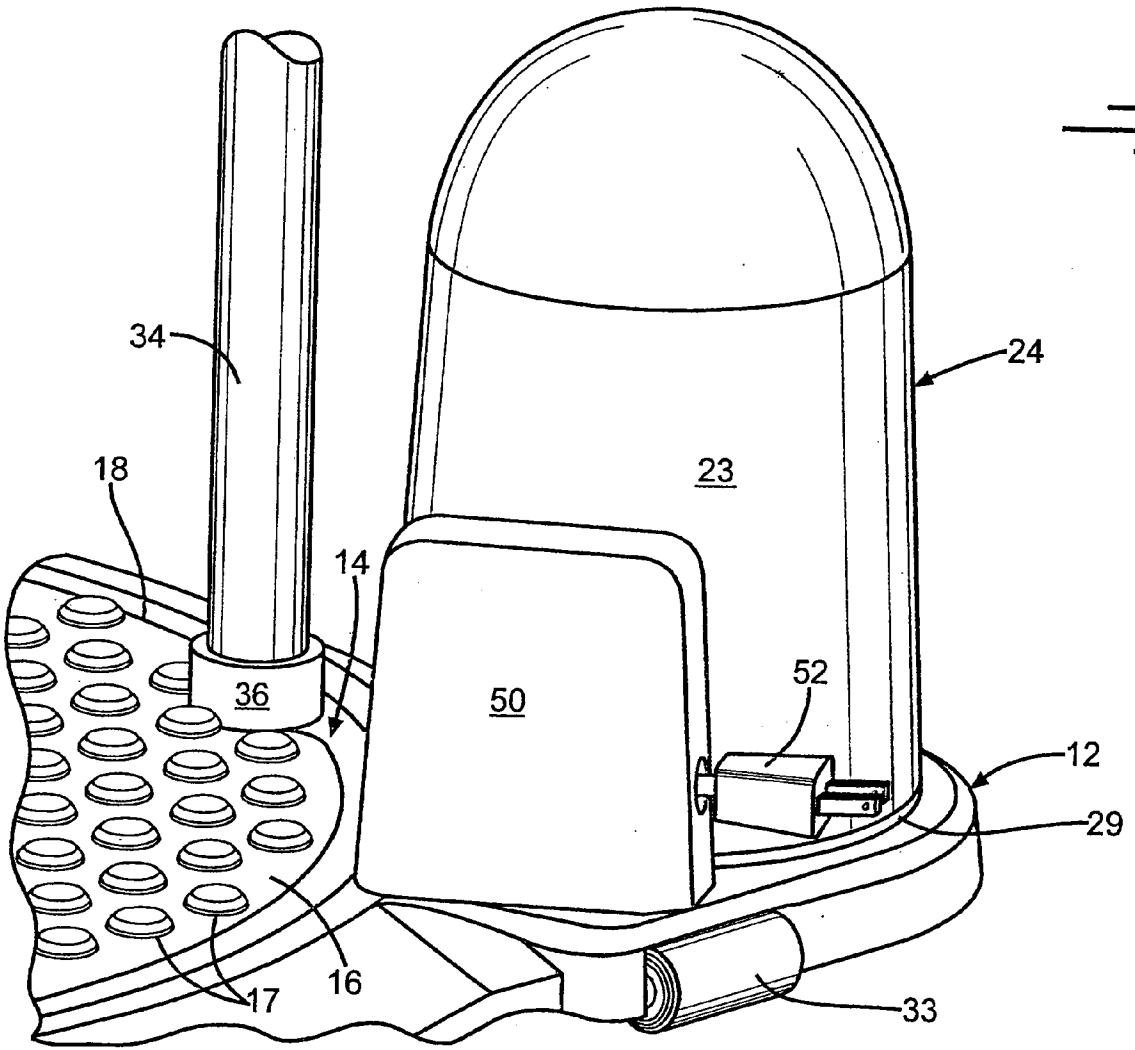
FIG. 7 is an enlarged fragmentary perspective of the motor housing, cord housing and fragmentary portion of the rotatable support platform.
Figure 8:
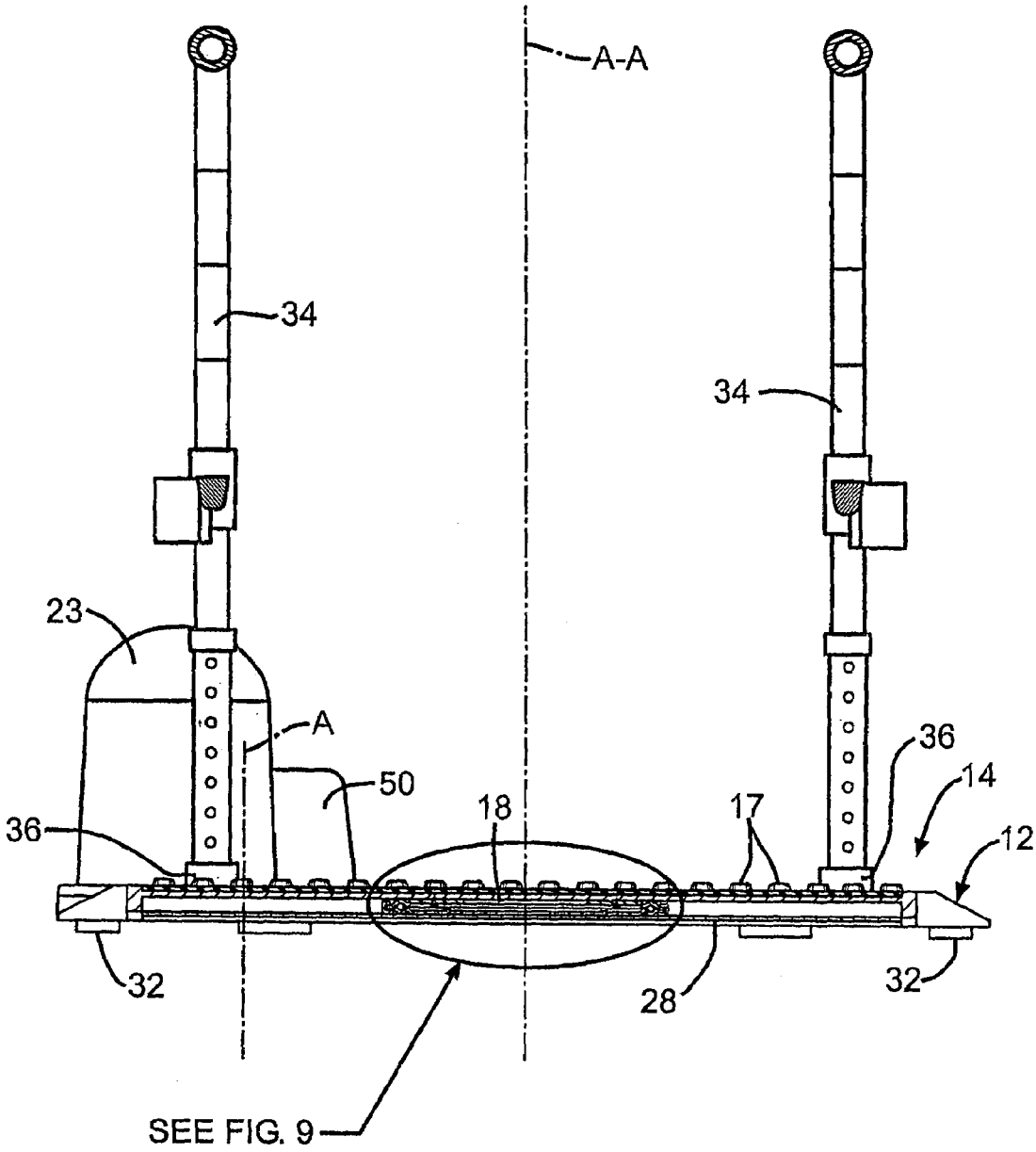
FIG. 8 is a sectional view taken through line 8—8 of FIG. 3.
Figure 9:
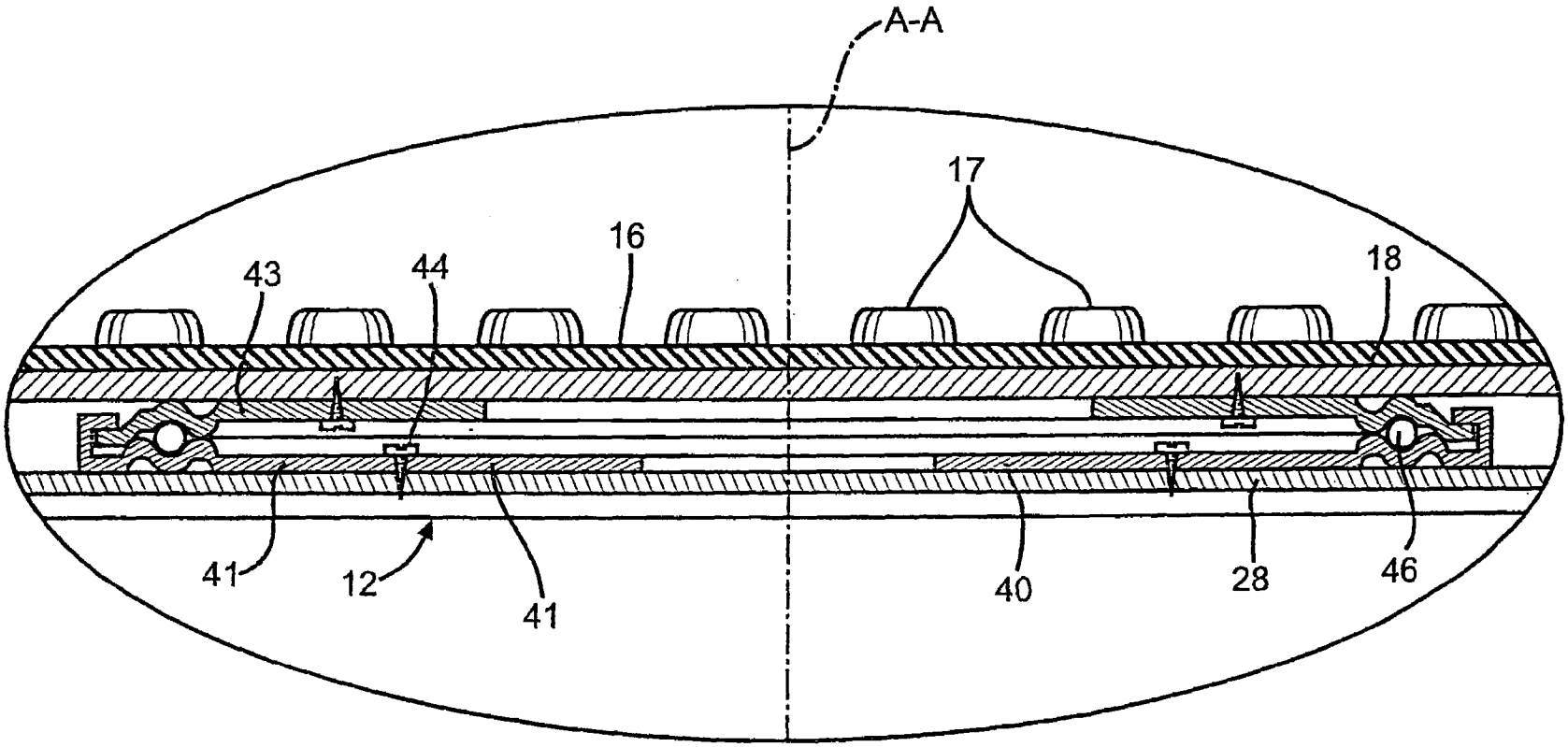
FIG. 9 is an enlarged fragmentary view of FIG. 8.

The rotatable disk 18 has an outer peripheral edge 19 positioned to be engaged by a power driven disk 20 mounted on a rotatable shaft 22 of an electric motor 24 mounted on the base 12. (See FIGS. 6, 7 and 10). The rotatable shaft 22 extends along and rotates about a second axis A which is parallel to axis A—A. The motor 24 is encased in a waterproof protective cover 23 secured to the base 12. A rubber ring 29 or other suitable sealant may be used to affect a waterproof seal between the cover 23 and the base 12. Additionally, the feature of providing a cover 23 over the motor 24, assures against a patient or object getting pinched by the motor while operating.

Figure 10:
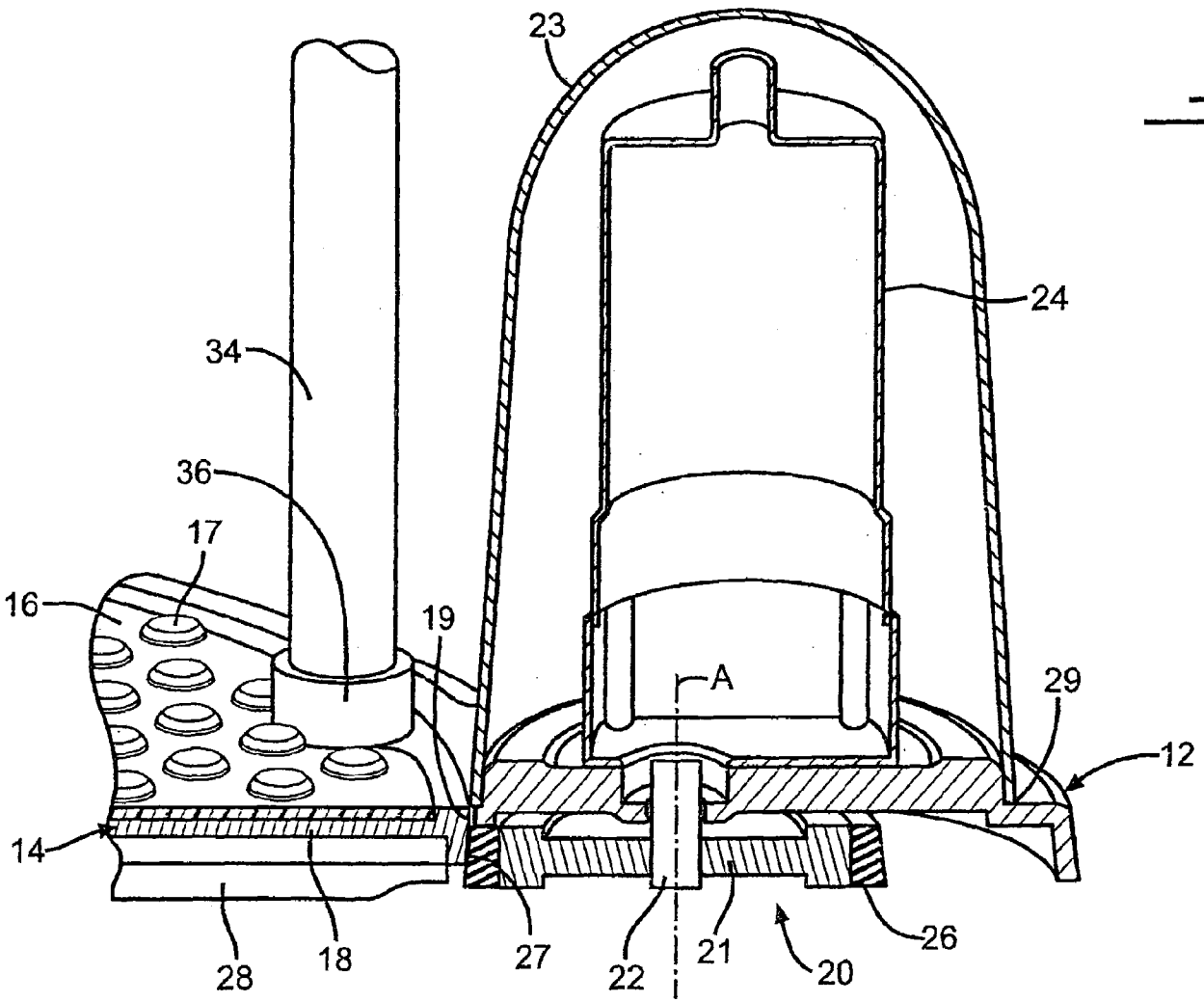
FIG. 10 is an enlarged fragmentary sectional view showing the power disk engaged to the rotatable disk.
Figure 11:
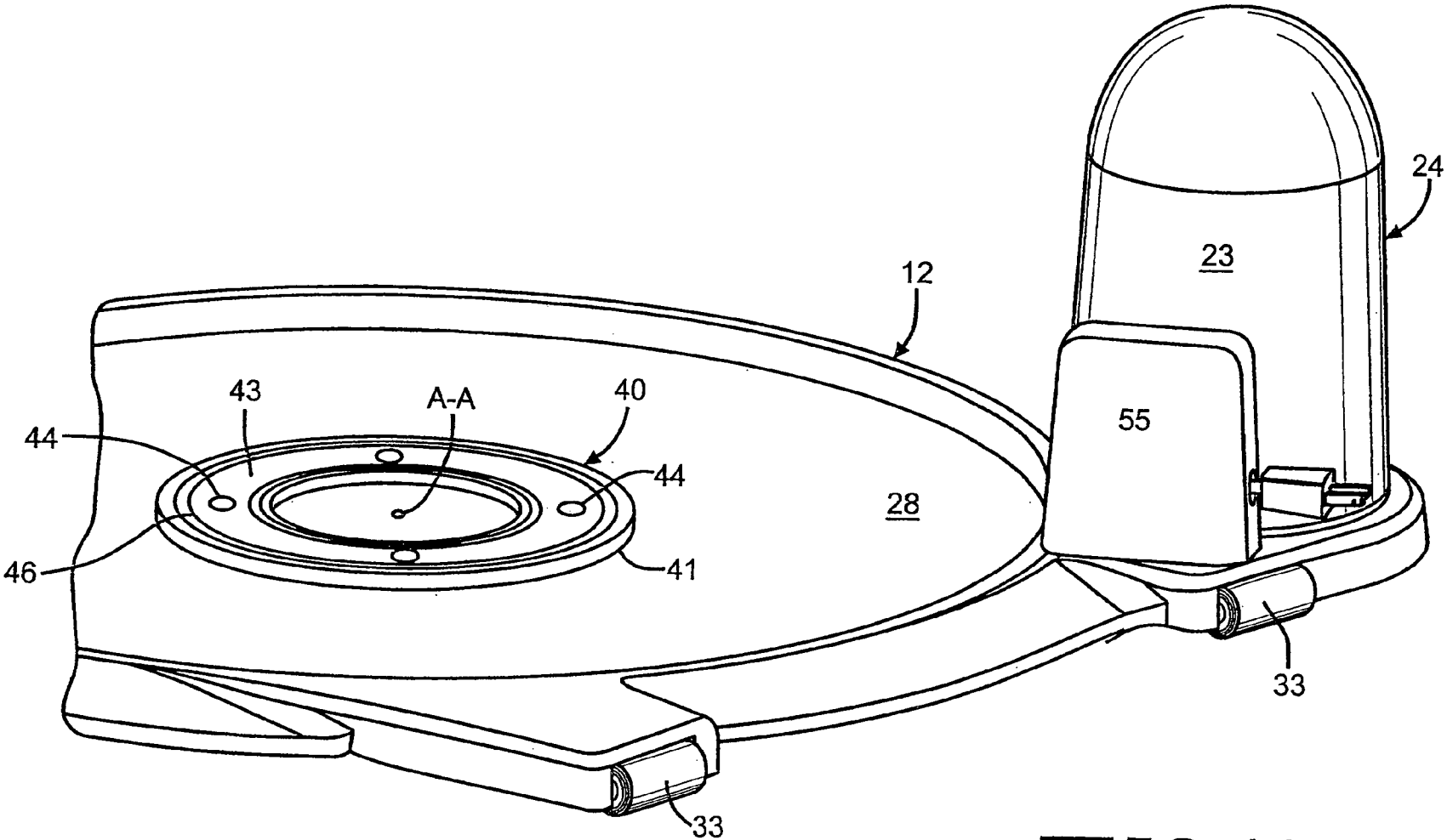
FIG. 11 is a perspective view of the base with the rotatable disk removed to show a low profile ball bearing turntable.

As can be seen in the enlarged fragmentary sectional view of FIG. 10, the power driven disk 20 has a hub 21 formed of a suitable plastic material such as acrylonitrile-butadiene-styrene copolymer (ABS) or other suitable rigid plastic material and is mounted on a power driven shaft 22 of the electric motor 24. The rotatable disk 18 including its outer peripheral edge 19 may also be formed of ABS or suitable rigid plastic material. Encircling the outer peripheral edge of the hub 21 is a wheel rubber 26. The wheel rubber 26 is adhesively or otherwise firmly engaged to the circumferential edge of the hub 21. The wheel rubber 26 has a circumferential edge 27 in mating engagement with the edge 19 of the rotatable disk 18. The type of rubber from which the wheel rubber is formed provides a circumferential edge 27 which is generally resistant to slipping relative to the engaged edge 19 of the rotatable disk 18 so that rotation of the power driven disk 20 causes rotation of the rotatable disk 18. On the other hand, the degree of friction developed between the edge 19 of the plastic rotatable disk 18 and the edge of the rubber wheel 26 is such as to permit some slippage in the event some external force prevented rotation of the disk 18 while the motor was running. Suitable types of rubber include neoprene, polyisoprene and a thermoplastic rubber such as Santoprene® sold by Advanced Elastomer, Akron, Ohio.

The circumferential edge 27 of the wheel rubber 26 is disposed at an angle relative to the axis A of the motor shaft 22, tapering inwardly toward the axis A in a direction from the bottom facing the floor upwardly toward the motor 24 and rotatable platform 14. Preferably, the included angle between the tapered edge 27 and the axis A is in the range of 0.5° to 7°; however, it could be significantly larger and could be more than 60°

The outer peripheral edge 19 of the rotatable disk 18 is tapered at a mating angle with the circumferential edge 27 of the wheel rubber 26. Thus, the edge 19 tapers at a preferred angle of 0.5° to 7° outwardly from the axis A—A about which it rotates in a direction from the bottom facing the floor upwardly toward the platform 14 and pad 16 on which the patient stands. As is the case with the angle of the circumferential edge 27, the angle of the peripheral edge 19 relative to the axis A—A could be much larger, even more than 60°. As will be appreciated, at the line of contact between the peripheral edge 19 and the circumferential edge 27, the peripheral edge 19 will be tapering inwardly toward axis A and preferably at substantially the same angle as the edge 27 in order to assure mating engagement therebetween. This may be clearly seen in FIG. 10 which shows at the line of contact, the peripheral edge 19 tapering inwardly toward the axis A of the power driven shaft 22 taken in a similar direction. As a result of the edge 19 being disposed at such mating angle with the edge 27, there is assured a maximum of interfacial engagement from top to bottom between the edges 19 and 27. That feature, coupled with the friction of the rubber from which the wheel rubber 26 is manufactured, assures that rotation of the power driven disk 20 will be imparted to the rotatable disk 18.

More importantly, the feature of disposing the edges 19 and 27 at the angles as described will serve as a means for causing increased force of engagement of the edge 19 against the edge 27 when a patient stands near the outer periphery of the support platform 14. The weight of the patient will impart a force downwardly on the rotatable disk 18 and its edge 19 thereby forcing the edge 19 more tightly against the edge 27 than is the case when no patient is standing on the rotatable platform 14. As will be appreciated, if the edges 19 and 27, along the line of contact, were disposed at an angle tapering away from the axis A of the motor shaft 22 in a direction from the bottom facing the floor toward the support platform 14, the weight of any patient standing on the support platform 14 would have a tendency to cause the edge 19 to separate from the edge 27 upon downward deflection caused by the weight of a patient.

The rotatable disk 18 is supported on a lower housing 28 which is an integral part of the base 12. The lower housing 28 has a plurality of integrally molded reinforcing ribs 30 extending radially outwardly from its axis A—A. A plurality of rubber feet 32 are mounted on the lower housing 28 for resting on the floor in a non-slip relationship.

Figure 4:
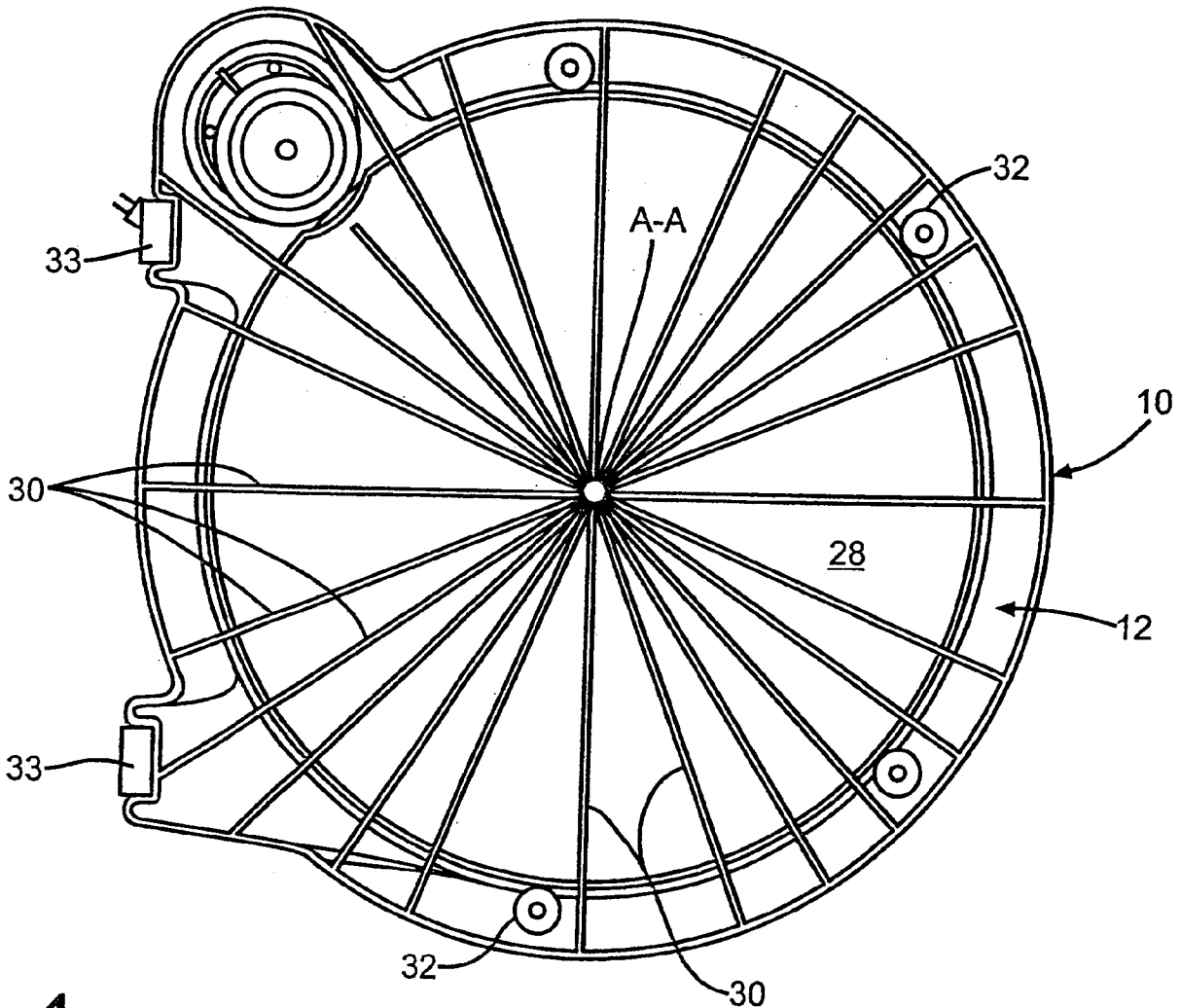
FIG. 4 is a bottom view of the assist device.
Figure 5:
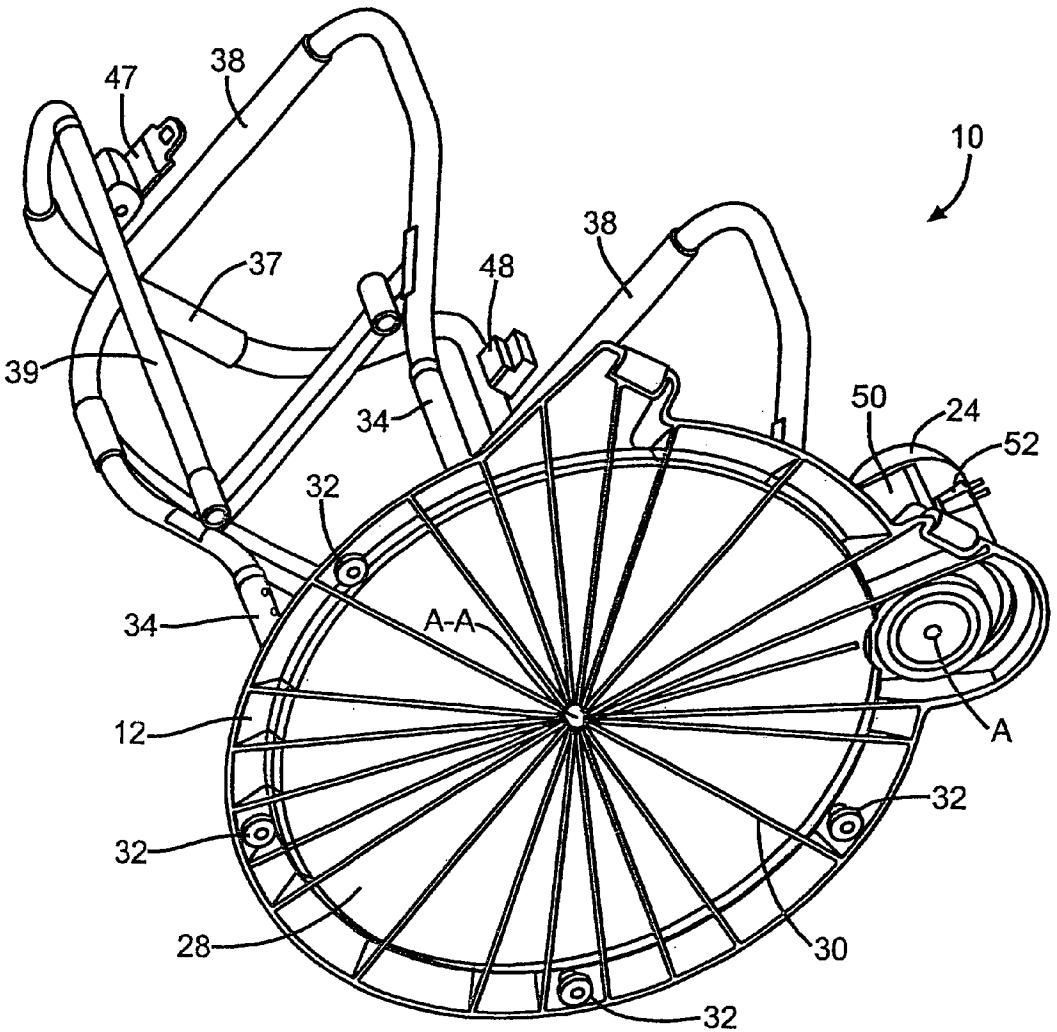
FIG. 5 is a perspective view looking toward the bottom of the assist device.

In order to permit ease of movement of the assist device 10 from one location to another preparatory to receiving a patient, there is provided a pair of rotatable wheels 33 supported on the base 12. As may be seen in FIG. 4, one of the wheels 33 may be positioned adjacent the motor 24 and the other may be spaced therefrom in a position spaced arcuately therefrom on the order of 30 to 60 degrees. When it is desired to move the assist device 10, it may be simply tilted so that the base 12 and lower housing 28 are at an angle relative to the floor and the wheels 33 firmly resting on the floor. The assist device 10 may then be easily pushed to the desired location to receive a patient.

The rotatable disk 18 is rotatably supported on the lower housing 28 by means of a low profile ball bearing turntable 40 such as that sold by McMaster-Carr under its part number 6031K18 or 6031K19. The low profile ball bearing turntable 40 includes a lower plate 41 which is secured by fasteners 42 to the lower housing 28 in an area encircling the axis A—A. The ball bearing turntable 40 also includes an upper plate 43 secured by fasteners 44 to the bottom of the rotatable disk 18. Ball bearings are housed in a circular race 46 thereby permitting the upper plate 43 to easily rotate relative to the lower plate 41.

Figure 2:
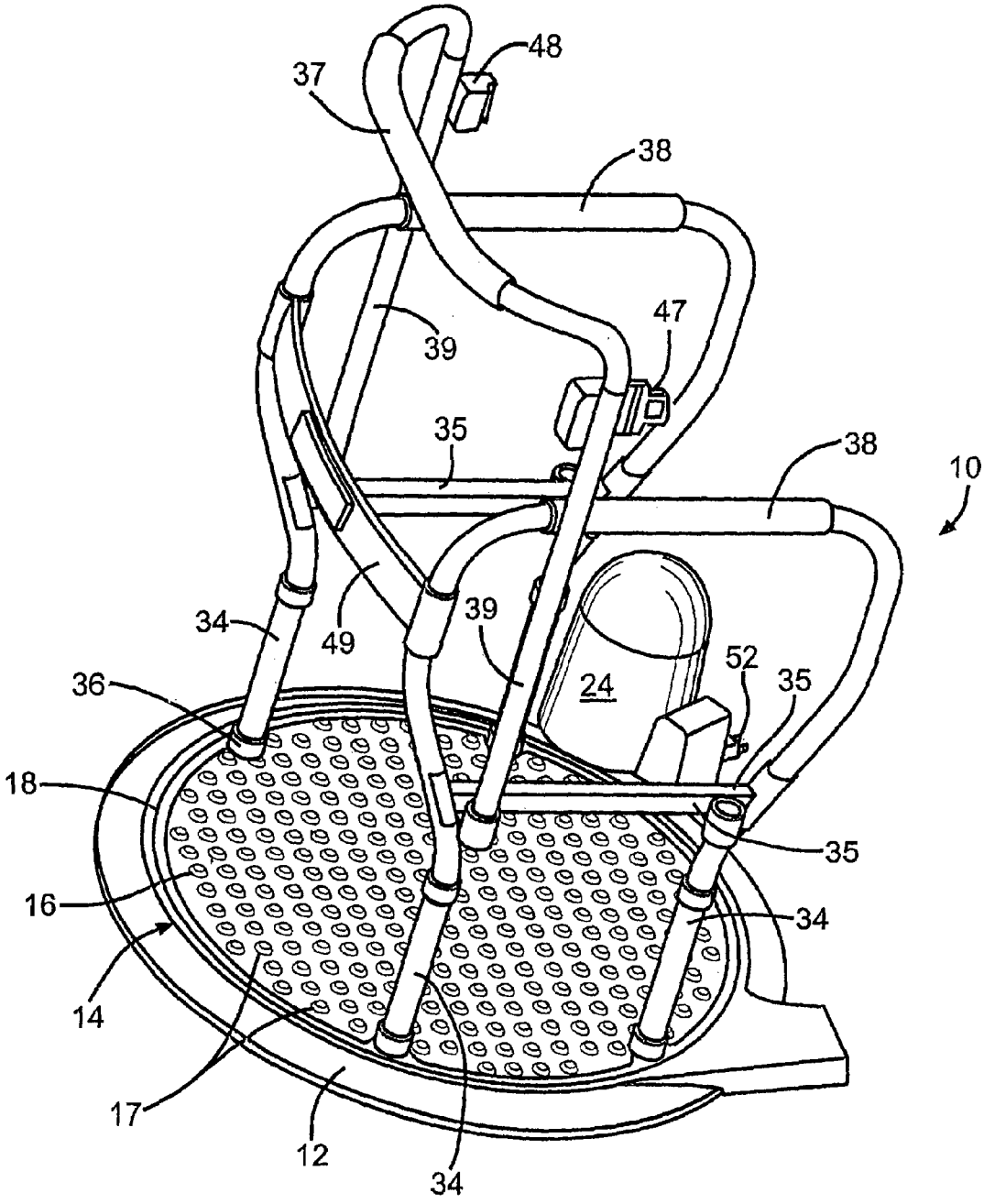
FIG. 2 is a view similar to FIG. 1 taken from a different angle.
Figure 3:
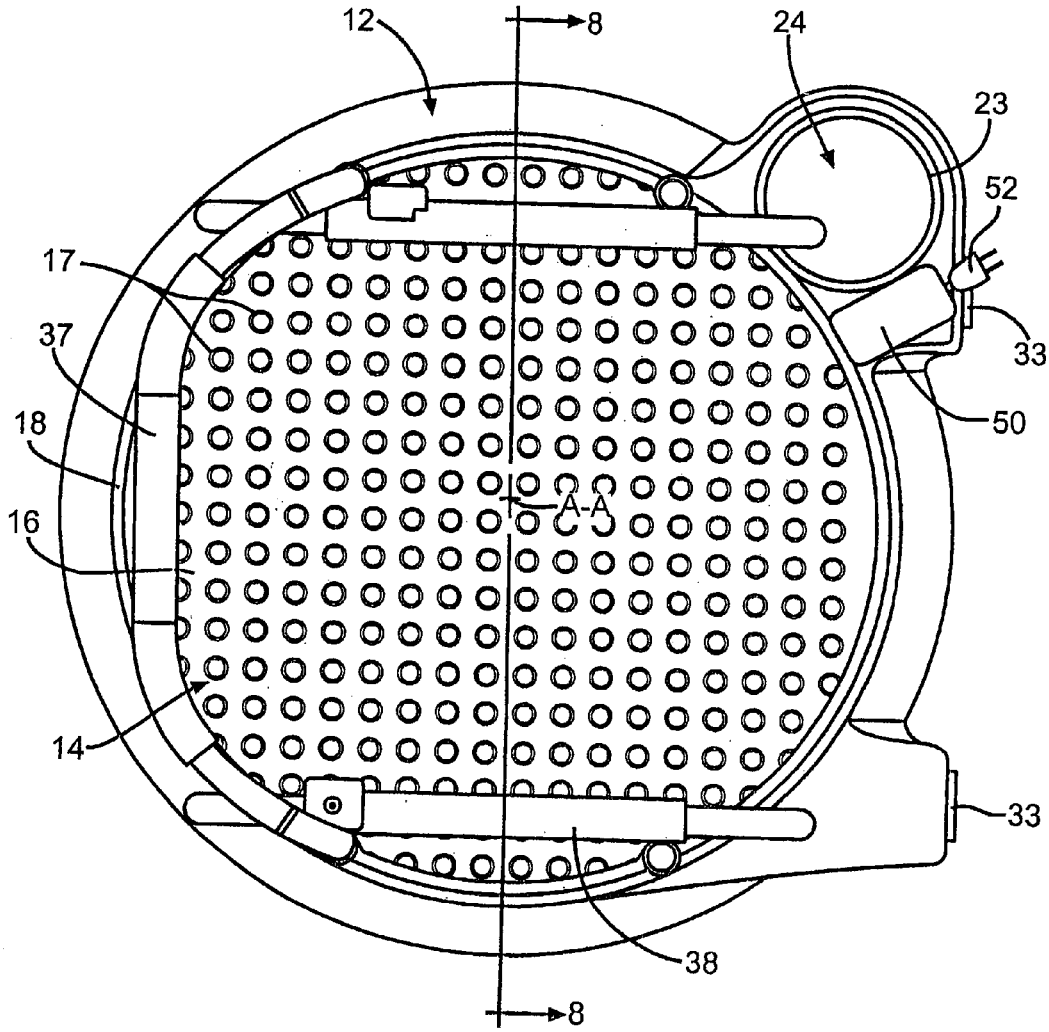
FIG. 3 is a top plan view of the assist device.

Extending upwardly from the support platform 14 are a plurality of support posts 34 resting in support sockets 36 mounted on the support platform 14. The number and configuration of the support posts 34 may be varied as desired. As shown in FIGS. 1 and 2, there are four posts 34 extending upwardly from their respective sockets 36 and forming part of a patient steadying structure.

Cross members 35, disposed in parallel relationship to one another, each extend between a pair of support posts 34 to provide rigidity to the gripping structure. As shown in the drawings, the posts 34 flare outwardly and upwardly to the desired height and then bend to provide a pair of horizontal spaced apart gripping members 38 which are parallel to one another and parallel to the support platform 14. If desired, additional support may be provided by upstanding posts 39 secured to the cross members 35. An additional gripping member 37 extends between the additional supports 39 to provide a closed front for support device 10. The additional gripping member 37 is contoured to the shape of the patient. A support belt 47 is secured to one of the additional posts 39 and a receptacle 48 for receiving and securing the support belt 47 is mounted on the other additional post 39. The support belt 47 may be strapped around the waist or back of a patient so that the patient is restrained between the belt 47 and the gripping member 37. An additional contoured support member 49 may be mounted on the front support posts 34.

The support posts 34 may be engaged to the sockets 36 with any desired "quick-release" type connecting means. Similarly, the cross members 35 and gripping members 37, 38 can be secured with quick-release type connectors in order to permit the assist device 10 to be readily disassembled and placed in an automobile truck, other vehicle or shipping container for transport to another location.

The electric motor 24 may be connected to a power source by means of an electrical cord retained in a cord housing 50 from which a plug 52 for the cord is shown extending. The motor 24 is housed in a plastic protective cover 23. The cord housing 50 and the cover 23 for the motor 24 are designed to protect the motor, electrical cord and interconnections waterproof manner in order that the patient assist device 10 may be washed and sterilized without damage. The motor is a commercially available motor, for example, one such as that sold by Dayton Electric as its electric gear motor Model No. 6Z075, which has associated therewith a remote handheld controller 60 (shown schematically in FIG. 1) for operating the motor 24. This type of motor is provided with internal gears which provide for a very slow rotation of the shaft. Even though the plug 52 is engaged to an electrical outlet, for a unit intended for an infirmed patient, there is no means on the structure of the assist device 10 for actuating the motor. This is for safety purposes so that an infirmed patient cannot operate the assist device 10 without the presence of an attendant. The handheld actuating controller 60 is synchronized with the motor 24 to slowly rotate its shaft 22 and the power disk 20 secured thereto and to thereby cause rotation of the rotatable disk 18 through the frictional interfacial engagement of the wheel rubber circumferential edge 27 and peripheral edge 19 of the rotatable disk 18. The handheld controller 60 can rotate the rotatable disk in either a clockwise or counter clockwise direction to any desirable angular location. Although the rotatable disk 18 could be turned a full 360°, from a practical standpoint it is preferred that it have the ability to turn both clockwise and counter clockwise. The direction and extent of angular rotation will, of course, be determined by the placement of the receiving patient support relative to the support from which the patient is being moved.

For an assist device intended for a less infirmed patient having agility to operate it himself/herself, the switch or other actuating means for motor 24 may be mounted on the assist device or otherwise placed within reach of the patient. Additionally, if desired, the assist device of the present invention could be battery powered.

Although the feature of utilizing a power driven disk, such as the disk 20, frictionally engaged to a peripheral edge of the rotatable support platform 14 is one means of powering rotation of the support platform and its rotatable disk, other means could be used.

Figure 12:
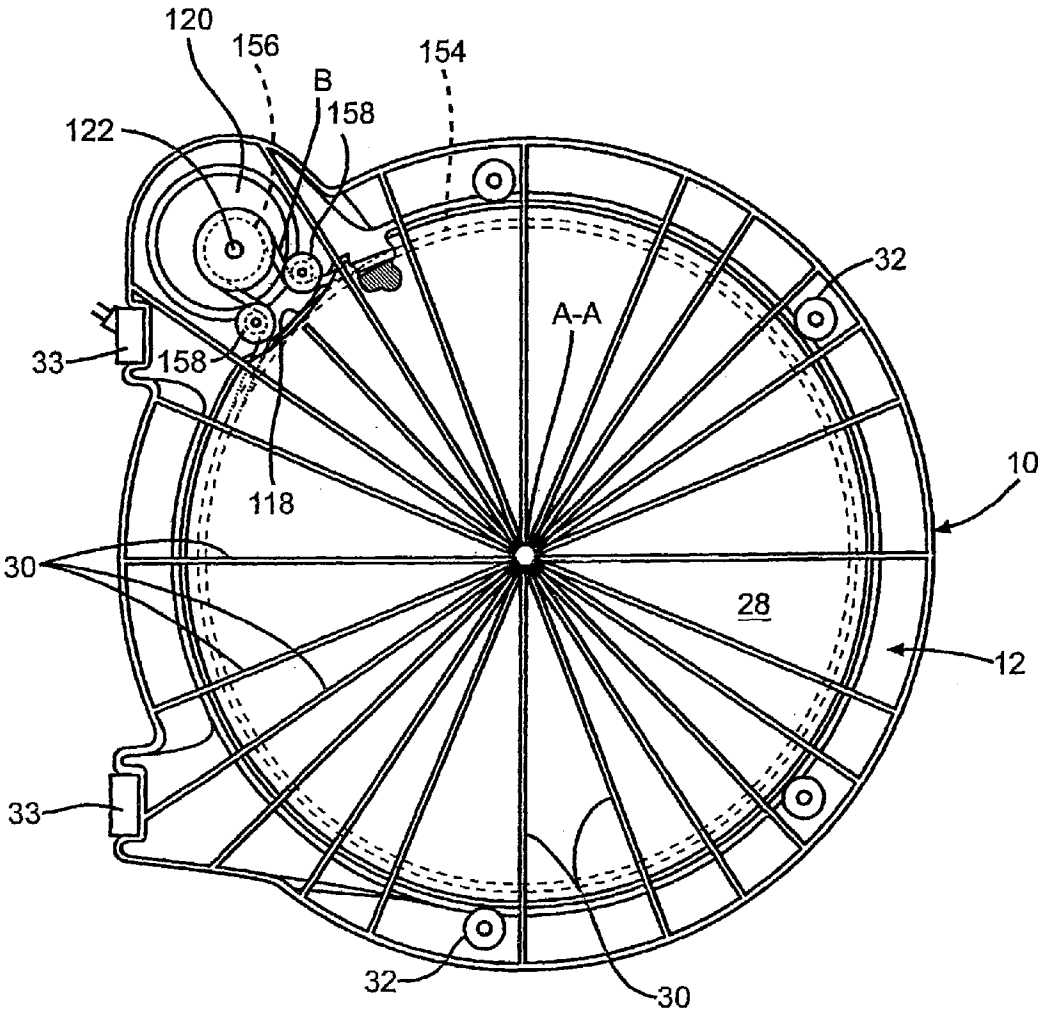
FIG. 12 is a bottom view of a modified embodiment for powering rotation of the rotatable platform utilizing a belt and pulleys.

Referring to FIG. 12, there is shown a modified embodiment of medical assist device 110 which utilizes a belt and pulley system for powering rotation of the rotatable disc 118 which is mostly hidden by the lower housing 28. The rotatable disc 118 has an outwardly facing circumferential groove 154 extending circumferentially therearound. Similarly, the powered disc 120 secured to the rotatable shaft 122 powered by the motor (not shown) has an outwardly facing circumferential groove 156. An endless belt B is positioned in the grooves 154 and 156 and in grooves of idle idler rollers 158. In other respects, the embodiment of FIG. 12 is like the embodiment of FIGS. 1–11.

Figure 13:
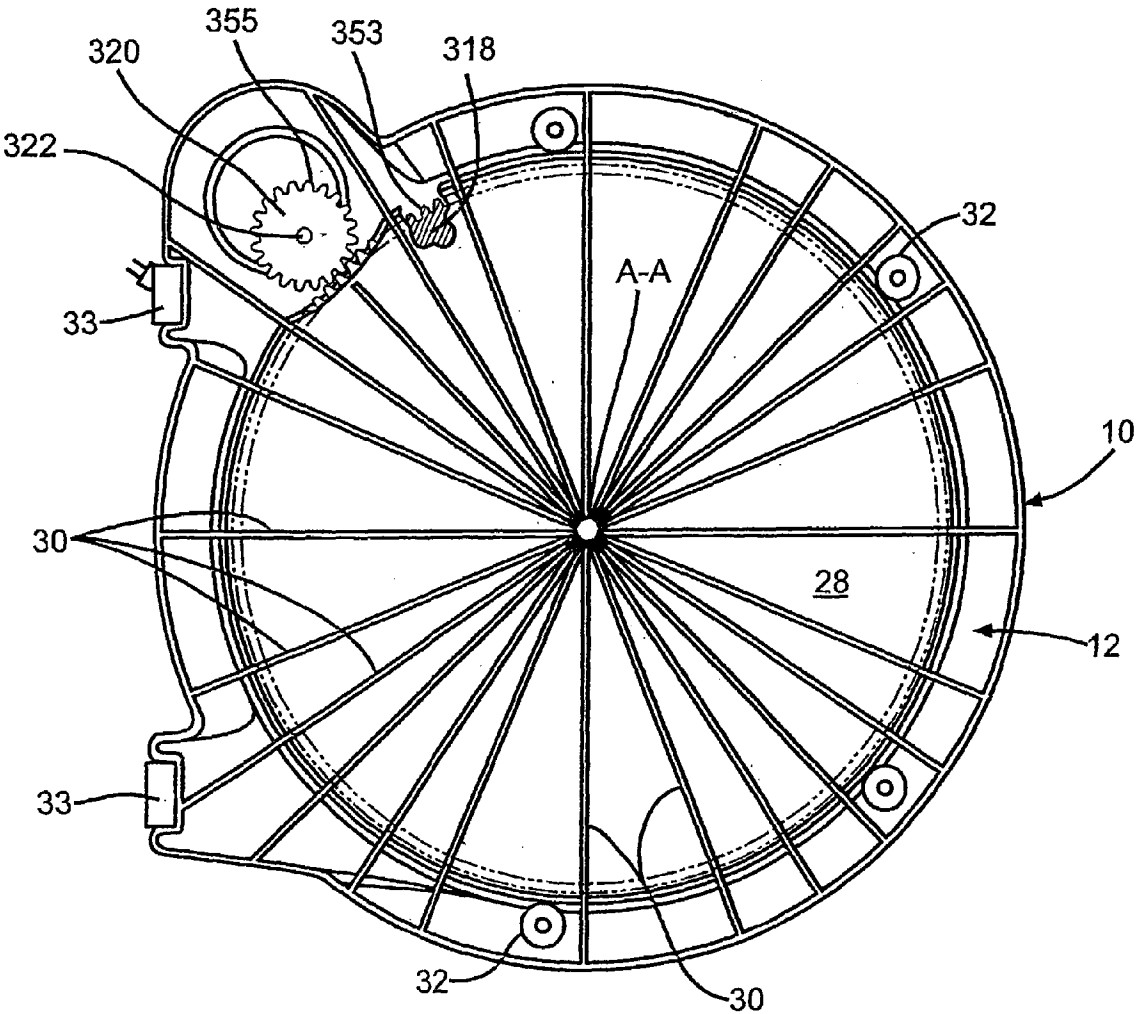
FIG. 13 is a bottom view of a further modified embodiment which utilizes a spur gear operatively connected to the motor to power rotation of the rotatable platform.

Referring to FIG. 13, there is shown yet another embodiment of assist device 310 having a rotatable disc 318 which has outwardly facing gear teeth 353 extending circumferentially therearound. Rotation of the rotatable disc 318 is effected by means of a power disc 320 having outwardly facing circumferential gear teeth 355 which engage the teeth 353 of the rotatable disc 318. The power disc 320 is mounted a rotatable shaft 322 powered by the motor (not shown). Thus, the power disc 320 and the rotatable disc 318 function as spur gears in effecting rotation of the rotatable disc.

Figure 14:
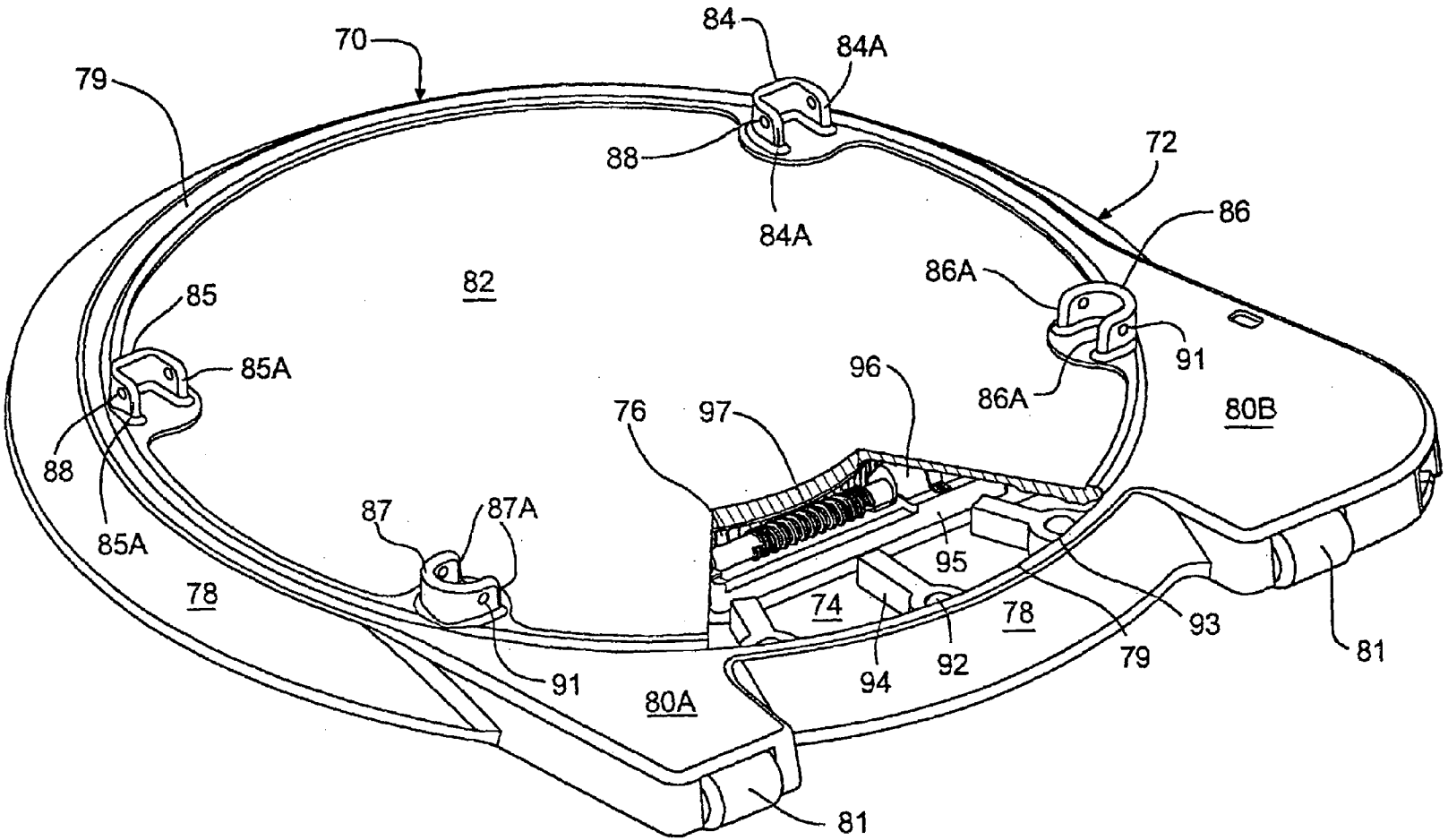
FIG. 14 is a perspective view of a further embodiment which utilizes a worm gear for powering rotation of the rotatable platform with the support posts removed for clarity and with a portion of the rotatable platform broken away.
Figure 15:
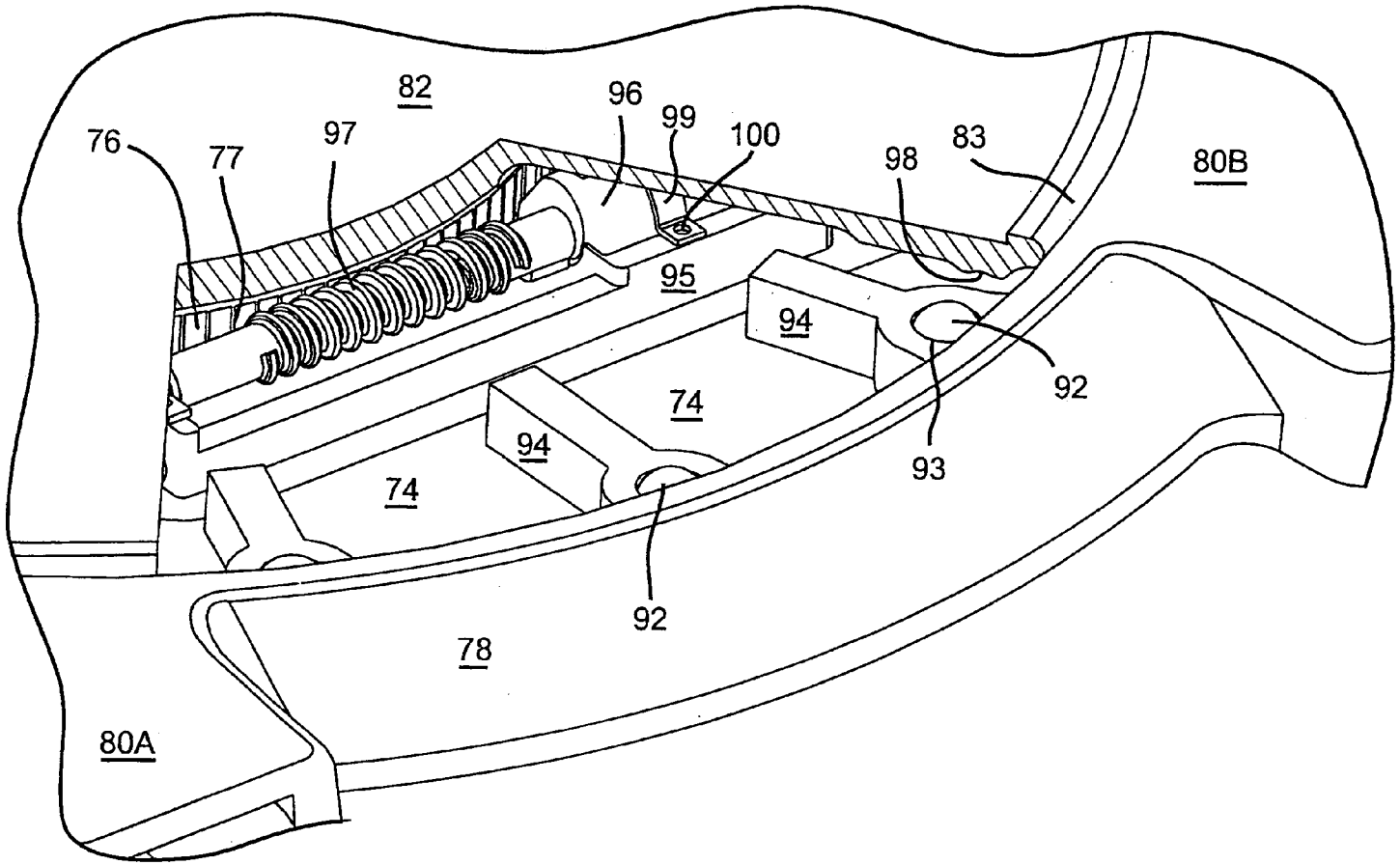
FIG. 15 is an enlarged fragmentary view of a portion of FIG. 14 showing the power means for rotating the rotatable platform.

Referring to FIGS. 14 and 15, there is shown a preferred embodiment of medical assist device generally designated by the numeral 70 but with the steadying structure removed. The assist device 70 includes a base member 72 having a bottom 74, the lower surface of which faces the floor and the upper surface of which has mounted thereon a rotatable wheel 76. The outer circumferential periphery of the rotatable wheel 76 has a plurality of gear teeth 77. The base 72 includes an upwardly sloping wall 78 extending upwardly from the bottom 74 to a top circumferential ridge 79 extending 360°. Preferably, the ridge 79 defines a plane. The upwardly sloping wall 78 also extends 360° except for two interruptions defined by spaced apart housings 80A and 80B in which are supported rotatable wheels 81. The ridge 79 is circular and defines the upper extent of a cavity in which the rotatable wheel 76 is positioned. As can be seen in FIGS. 14 and 15, the gear teeth 77 defining the circumferential outer limit of the rotatable wheel 76 are spaced radially inwardly from the inner edge of the ridge 79.

Mounted on the rotatable wheel 76 for rotation therewith is a patient support platform 82. The patient support platform extends radially outwardly beyond the outer periphery of the rotatable wheel 76 as defined by the gear teeth 77 extending circumferentially therearound. The support platform 82 lies on a plane substantially co-planar with the ridge 79 and extends radially outwardly a distance sufficient to leave only a small gap between its outer edge 83 and the ridge 79.

A plurality of sockets 84, 85, 86 and 87, for mounting posts or post segments of a patient steadying structure, are positioned in spaced apart locations on the support platform 82 near the outer edge 83. The sockets 84, 85, 86 and 87 are semicircular in configuration. The two socket 86 and 87 which are closest to the housings 80B and 80A, respectively, have edges 86A and 87A respectively, each of which defines an opening, with the edges 86A and 87A being oriented such that the respective openings defined thereby face each other. In contrast, the sockets 84 and 85, which also have a semicircular configuration, have edges 84A and 85A, respectively, which define openings which face toward the sockets 86 and 87, respectively. The sockets 84 and 85 are each provided with apertures 88 for receiving pins designed to extend through apertures of the support posts or post segments received therein. If desired, the sockets 86 and 87 could also be provided with apertures 91 for receiving pins extending through apertures in the respective posts or post segments supported therein.

As can be seen in FIGS. 14 and 15, the outer peripheral portion of the support platform 82 in the area between the outer edge 83 and the gear teeth 77 extends as a cantilever in that area and, except for underlying support, would be subject to downward deflection from the weight of a patient standing in that area. Accordingly, there is provided a series of ball bearings 92 each of which is retained in a pocket 93 formed in the end of radially extending reinforcing members 94. The reinforcing members 94 provide reinforcing for the base 72.

Also positioned in the cavity with the rotatable wheel 76 is a platform 95 on which is mounted an electric motor 96 for powering rotation of the rotatable wheel 76. The electric motor 96 is secured to the platform 95 by straps 99 extending thereover and bolts 100 affixed to the platform 95. The electric motor 96 powers the rotation of a worm gear 97 which is engaged to the gear teeth 77 of the rotatable wheel 76. The electric motor 96 has the capability of rotating the worm gear 97 either in a clockwise or a counterclockwise direction to thereby rotate the platform 82 in either a clockwise or counterclockwise direction. The radially extending reinforcing members 94 in the area between the housings 80A and 80B have ends which contact the platform 95 on which the motor is mounted to hold it firmly in position. A suitable type of electric motor which may be used for the motor 96 is one manufactured by Bühler Motor GmbH of Germany as its Model No. 1.61.077612.00.

As can be readily seen in FIG. 15, the lower side of the support platform 82 in the area adjacent the outer edge 83 is contoured to provide an arcuate trough 98 in which the ball bearings 92 can ride while supporting the platform 82 as it is rotated in response to rotation of the worm gear 97.

Referring to FIGS. 16–23, there is shown a preferred form of post, cross members and gripping members for use in, use by or for the patient for steadying purposes while standing on the rotatable platform. For the purposes of description this will be referred to as steadying structure. It has the ability to be readily collapsed without being disassembled in order to provide a compact device which can readily be transported to one location to another. It will be described with reference to the embodiment shown in FIGS. 14 and 15; however, it could be obviously be used with other embodiments of bases and rotatable platforms.

Figure 16:
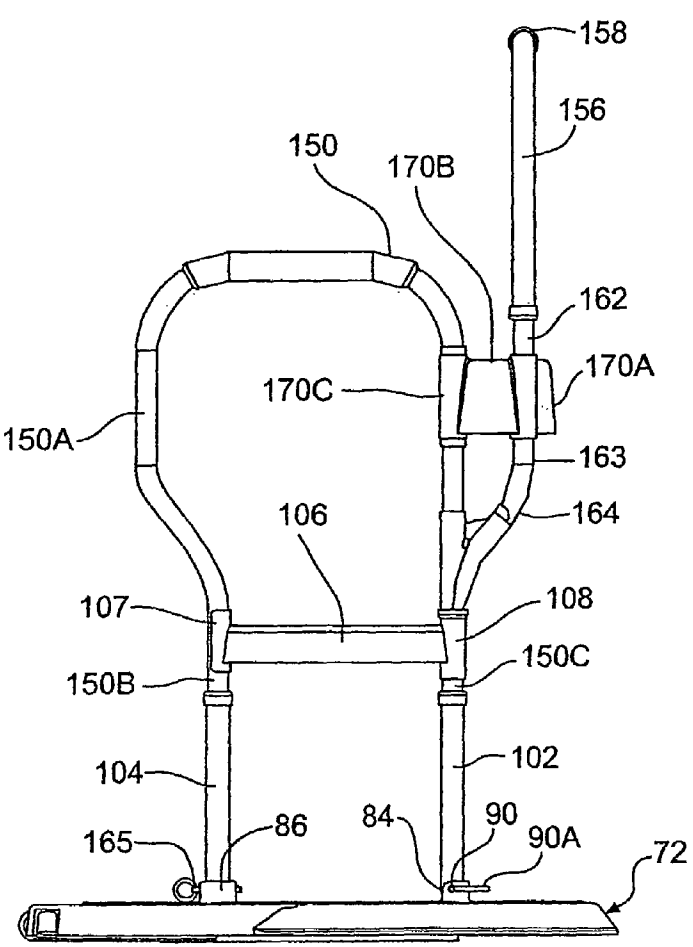
FIG. 16 is a side view of another embodiment of medical assist device.

The steadying structure includes four post segments 102, 103, 104 and 105 which are received respectively in sockets 84, 85, 86 and 87. For purposes of this specification, post segments 102 and 103 will be referred to as the front post segments and post segments 104 and 105 will be referred to as the rear post segments. The front post segments 102 and 103 are fastened in their respective sockets 84 and 85 by means of pins 90 extending through apertures 88 (see FIG. 14) and corresponding apertures on the post segments 102 and 103. As a result of the sockets 84 and 85 being semicircular in shape and having an opening between the respective edges 84A, 84A and 85A, 85A, it is clear that the post segments 102 and 103 may rotate about the pivot formed by the pins 90. In FIG. 16, the pin 90 is shown as having a leg 90A disposed at a right angle to the pin portion which extends through the apertures 88 and post segment 102. The rear post segments 104 and 105 may be secured in their respective sockets 86 and 87 by means of pins 99 extending through apertures 91 and through aligned apertures at ends of such post segments.

Telescopically received in front post segment 102 and rear post segment 104 is first side member 150. A second side member 152 is telescopically received in the opposing post segments, namely, front post segment 103 and rear post segment 105. Each of the side members 150, 152 is generally U-shaped with an outwardly extending bowed portion 150A and 152A.

The side member 150 has a rear leg portion 150B engaged to post segment 104 and a front leg portion 150C engaged to post segment 102. Similarly, the side member 152 has a rear leg portion 152B engaged to post segment 105 and a front leg portion 152C engaged to post segment 103.

Figure 23:
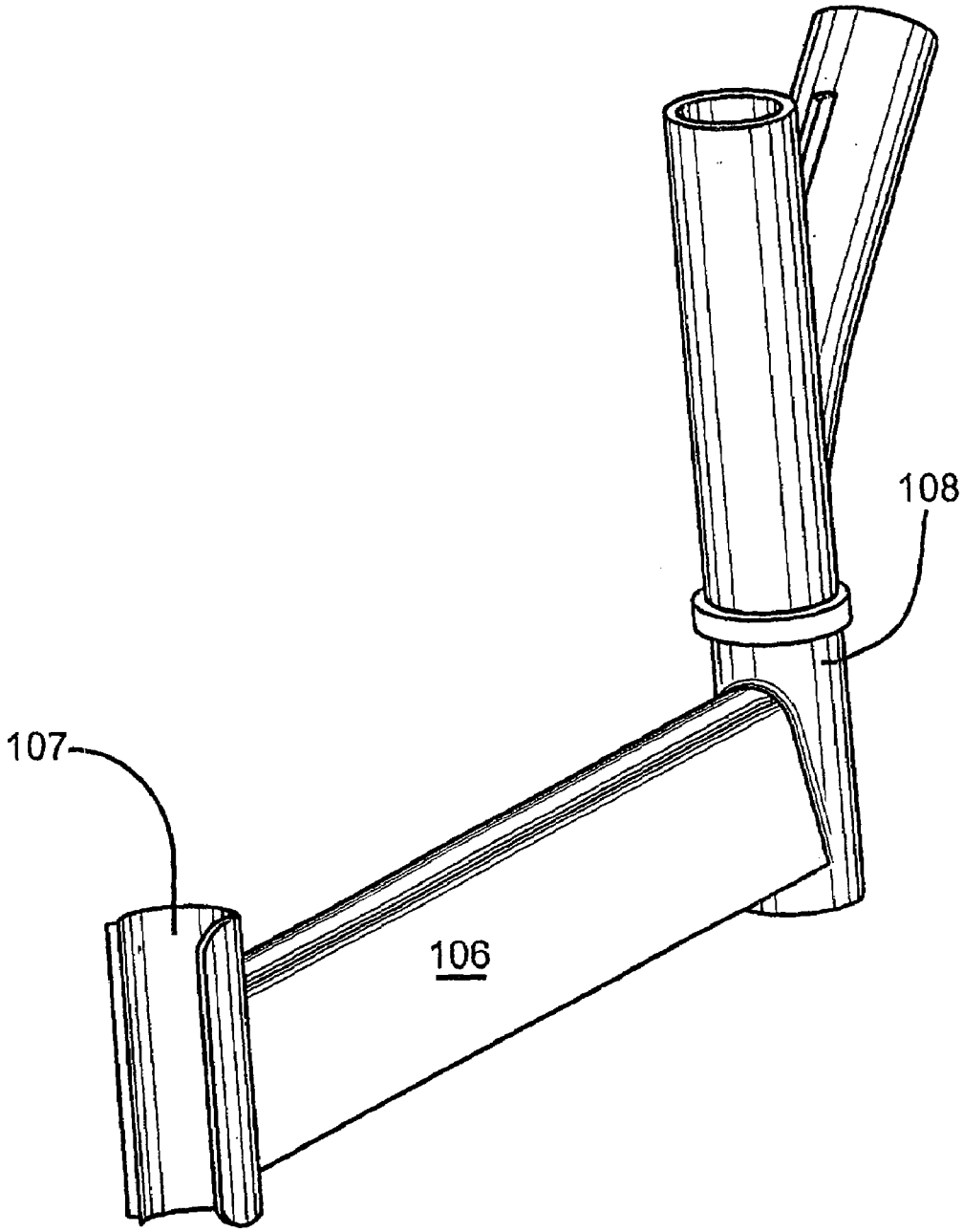
FIG. 23 is a perspective view showing a connector for joining segments of a side member with the back member.

Extending between the leg portions 150B and 150C is a connector member 106. The connector member 106 has a bracket 107 engaged to the rear leg portion 150B and a sleeve shaped receptacle 108 which receives the front leg portion 150C. The receptacle 108 has an internal configuration which serves the dual function of permitting the leg segment 150C to be rotated therein while being supported therein and at the same time for receiving a leg portion of the front member as hereinafter described. FIG. 23 is a perspective view of the connector member 106.

The front member 156 is U-shaped and has a cross piece 157 with a central gripping section 158 lying generally in a horizontal plane for ease of gripping by a patient. Extending downwardly from the cross piece 157 are a pair of spaced apart leg portions 159 each having a series of apertures 161 for use in adjusting the height of the central gripping section 158. The leg portions 159 are tubular and are sized to receive in telescoping relationship a joinder member 162 having a cylindrical upper section 163 which is slideably received in the leg portion 159 and a lower section 164 which is curved and contoured at its free end to be received in the upper end of the sleeve 108 of the connector member 106. The front leg portion 150C which is also received in the sleeve 108 may be rotated therein and rotated relative to that portion of the lower section 164 of the joinder member 162. The upper cylindrical section 163 has apertures which may be aligned with the apertures 161 of the leg portions 159 and fitted with a pin or other fastening elements for connecting at the desired height of the central gripping portion 158. A similar connector member 106 is provided for engagement with the leg portions 152B and 152C of the opposing side member 152.

If desired, an additional reinforcing member 170 may be provided to add to the stability of the medical assist device. As can be seen in the drawings, the reinforcing member 170 may be a one piece member having a front 170A extending in between the upper cylindrical sections 163 of the joinder member 162 and a pair of side portions 170B extending between such upper cylindrical sections 163 and the cylindrical portions 150A of side member 150 and a similar cylindrical section of side member 152. The side portions 170B extend to gripping portions 170C engaged to the side members 150 and 152.

If desired, the forward post segments 104 and 105 may be fastened in their respective sockets 86 and 87 with pin connectors 165; however, it will be readily appreciated that such pin connectors 165 must be removed prior to collapsing the support structure in preparation for transporting it to another location.

Figure 17:
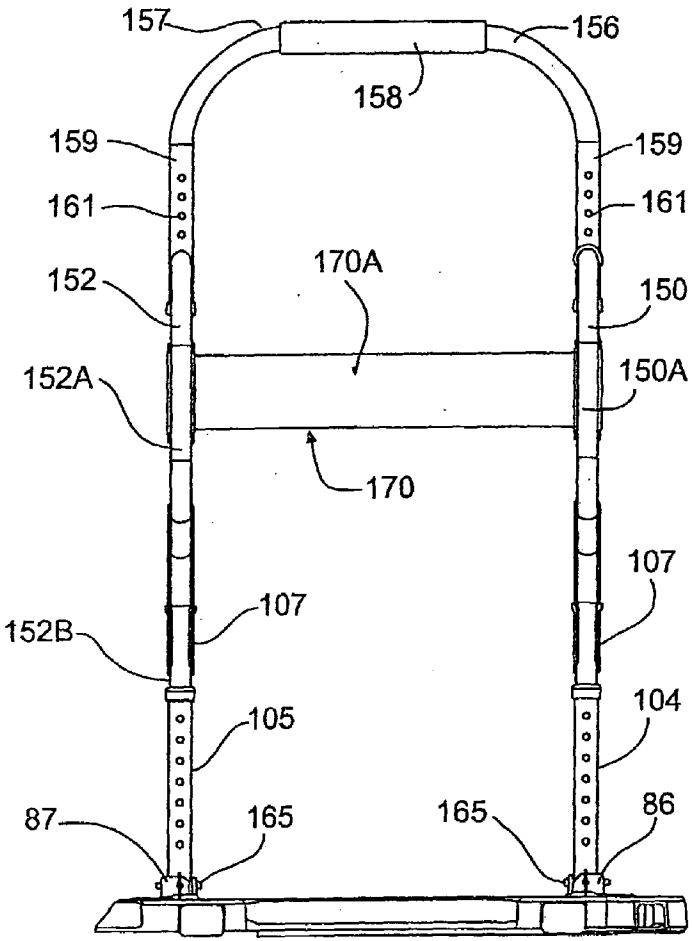
FIG. 17 is a view similar to FIG. 16 but showing the device as turned 90°.
Figure 18:
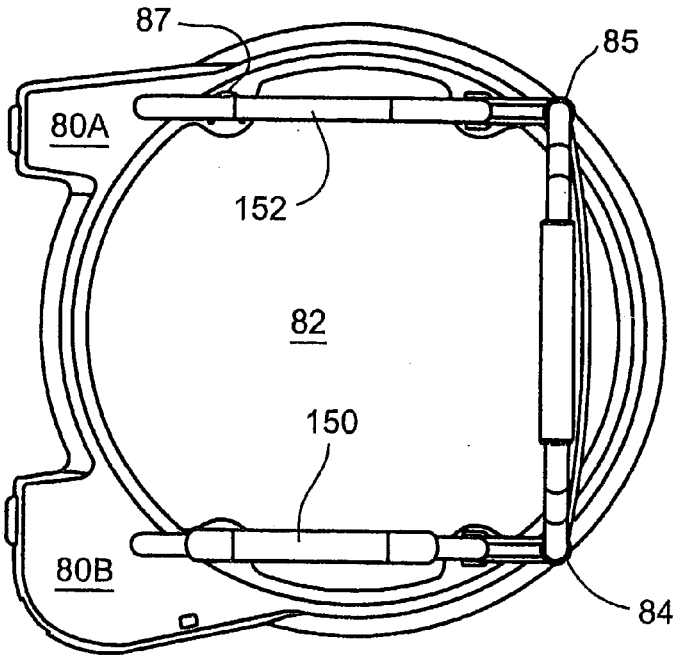
FIG. 18 is a top plan view of the modified embodiment of FIG. 16.
Figure 19:
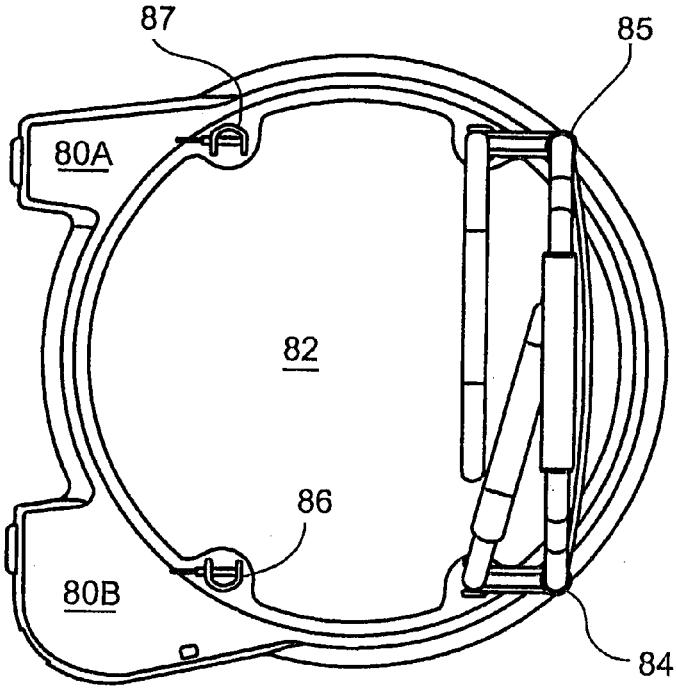
FIG. 19 is a view similar to FIG. 18 but showing the device with the first and second side members swung to a folded position toward the end member.
Figure 20:
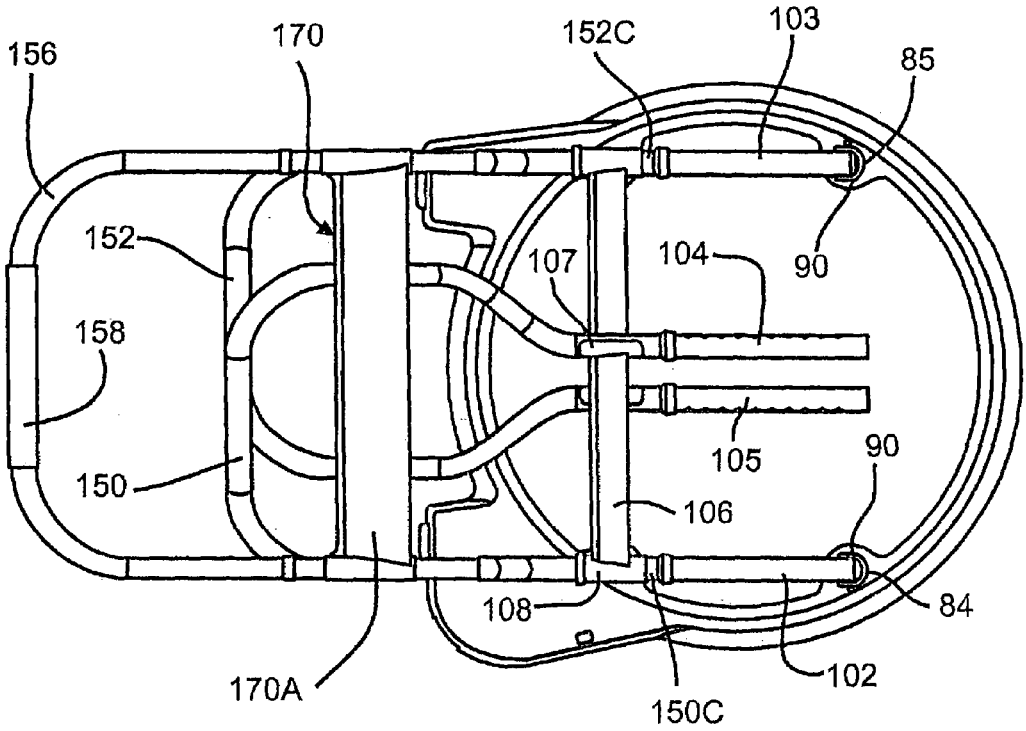
FIG. 20 is a view similar to FIG. 19 showing the folded side numbers and the end member pivoted toward the floor into engagement with the rotatable support.
Figure 21:
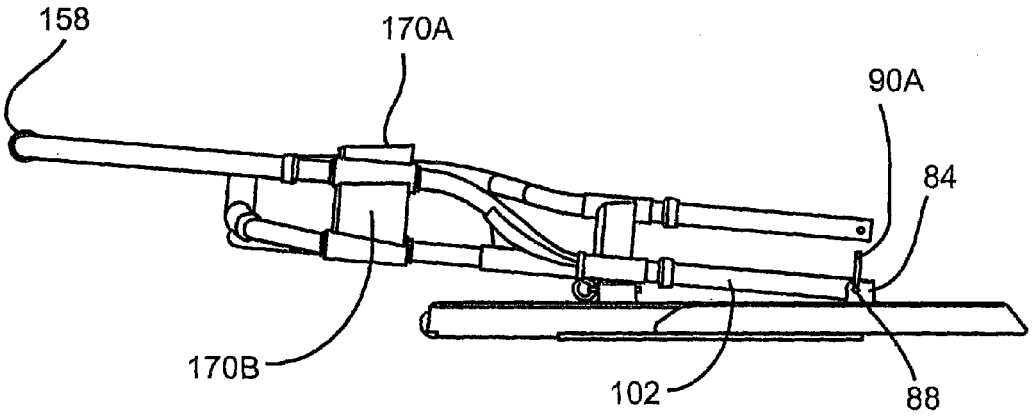
FIG. 21 is a side view showing the device in the folded and collapsed positioned of FIG. 20.
Figure 22:
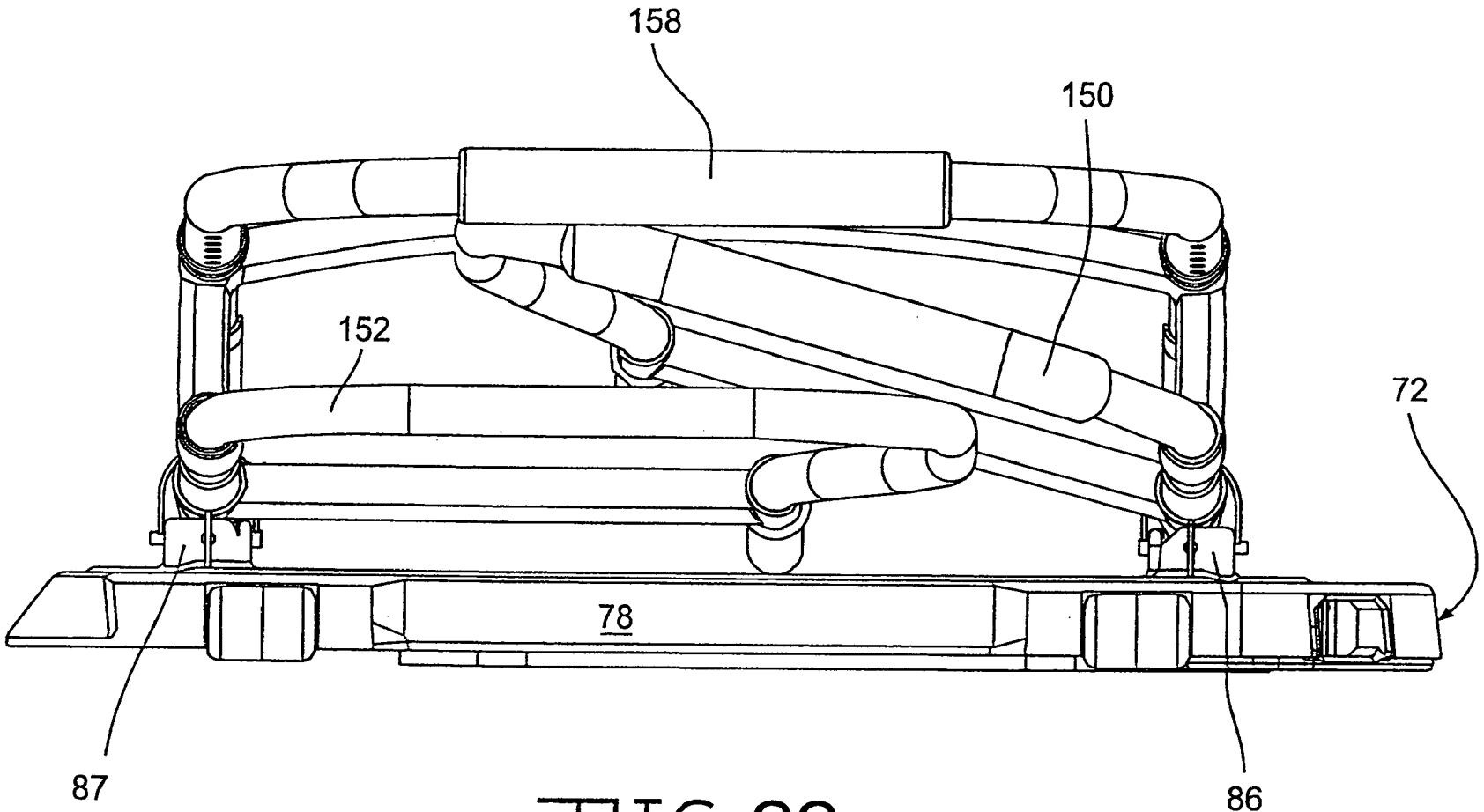
FIG. 22 is a view similar to FIG. 21 with the device turned 90° from that shown in FIG. 21.

When in use for assisting a patient to be moved from a bed to a chair or other support device, the medical assist device has the steadying structure with the side members 150 and 152 open as shown in FIGS. 16–18 and, preferably, with a fastener 165 retaining the post segments 104 and 105 in their respective sockets 86 and 87. When it is desired to transport the medical assist device to another location, the support structure may be readily collapsed by simply removing the fasteners 165 and rotating the side members 150 and 152 and the post segments 105 and 104 connected thereto, respectively, to the position shown in FIG. 19. This results in the segments 150C and 152C received in the sleeves 108 rotating therein and also rotating in the gripping portions 170C of the reinforcing member 170. With the side members 150, 152 thus positioned as shown in FIG. 19, the entire support structure may be pivoted downwardly about the pins 90 securing the respective leg post segments 102 and 103 about their respective connectors 84 and 85 to the position shown in FIGS. 20 and 21.

As will be appreciated, the unit may now be easily transported to a different location or different medical facility while occupying a minimum of space.

As will be appreciated, the collapsible support structure can be used on a medical assist device which is powered as shown in FIGS. 1–16 or on a medical assist device which is manually rotatable.

Figure 24:
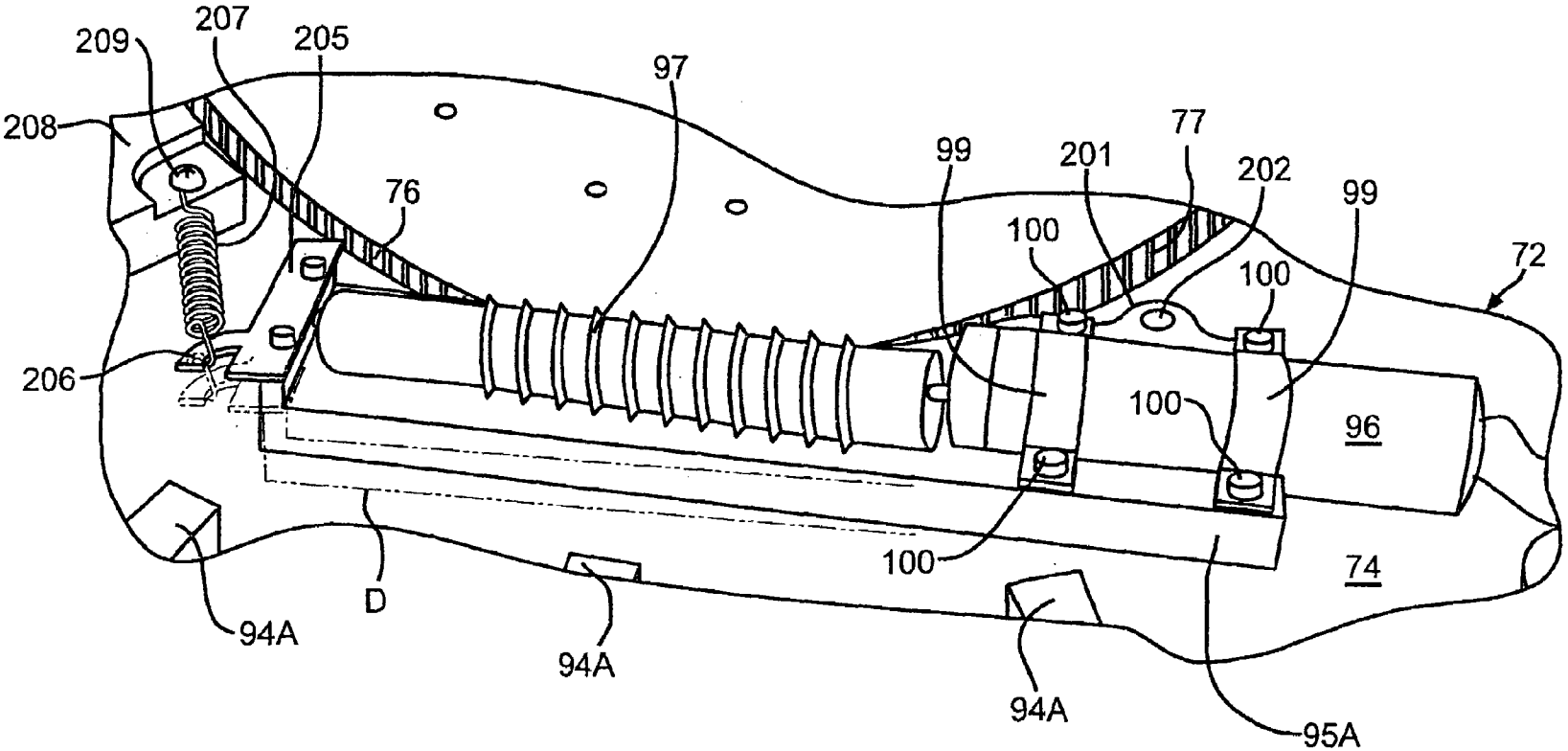
FIG. 24 is a fragmentary perspective view showing a modification to the embodiment of FIGS. 14 and 15.

Referring to FIG. 24, there is shown a modified mounting means 95A on the bottom 74 of the base member 72. As in the embodiment of FIGS. 14 and 15, the motor 96 is secured to the platform 95A by straps 99 extending thereon and fastened to the platform by bolts 100. As in the previous embodiment, the motor powers rotation of a worm gear at 97 adapted to engage the gear teeth 77 of the rotatable wheel 76.

The platform 95A is provided with an ear 201 in the area adjacent the motor 96. The ear 201 has an aperture 202 in which is positioned a pivot pin which is secured to the bottom 74. The platform 95A is able to pivot about the pivot pin extending into the aperture 202 from a position shown in full lines in FIG. 24 at which the worm gear 97 is engaged to the gear teeth 77 of the rotatable wheel to a position as shown by the dashed lines D at which the worm gear is disengaged from the gear teeth 77. The ability of the platform 95A and the worm gear 97 powered by the motor 96 mounted thereon to pivot from an engaged position with the gear teeth 77 to a disengaged position shown by the dashed lines D, provides a feature for preventing breakage of teeth on either worm gear 97 or the gear teeth 77 if the platform becomes jammed and cannot turn.

At the opposing end of the platform 95A there is provided a bracket 205 with an ear 206 to which is secured a tension spring 207. The opposing end of the tension spring 207 is fastened to a fixed base member 208 by a screw 209. The tension on the tension spring 207 is sufficient to keep the worm gear 97 engaged to the gear teeth 77 during normal operation but a strength which will yield to permit the platform 95A to pivot outwardly to disengage the worm gear 97 from the gear teeth 77 in the event of a jam up preventing rotation of the rotatable wheel 76.

As will be appreciated, under this embodiment, radially extending reinforcing members 94A are shorter than the reinforcing members 94 of the embodiment of FIGS. 14 and 15 and are spaced from the platform 95A thereby permitting the platform 95A to rotate.

Although the resilient means for yieldingly holding the worm gear 97 mounted on platform 95A in engagement with the gear teeth 77 has been described as a tension spring 207; it will be appreciated that other means may be provided for yieldingly urging the platform 95A to a position at which the worm gear will engage the gear teeth 77. Such other means could include a compression spring pushing against the side of the platform 95A facing away from the gear teeth.

Figure 25:
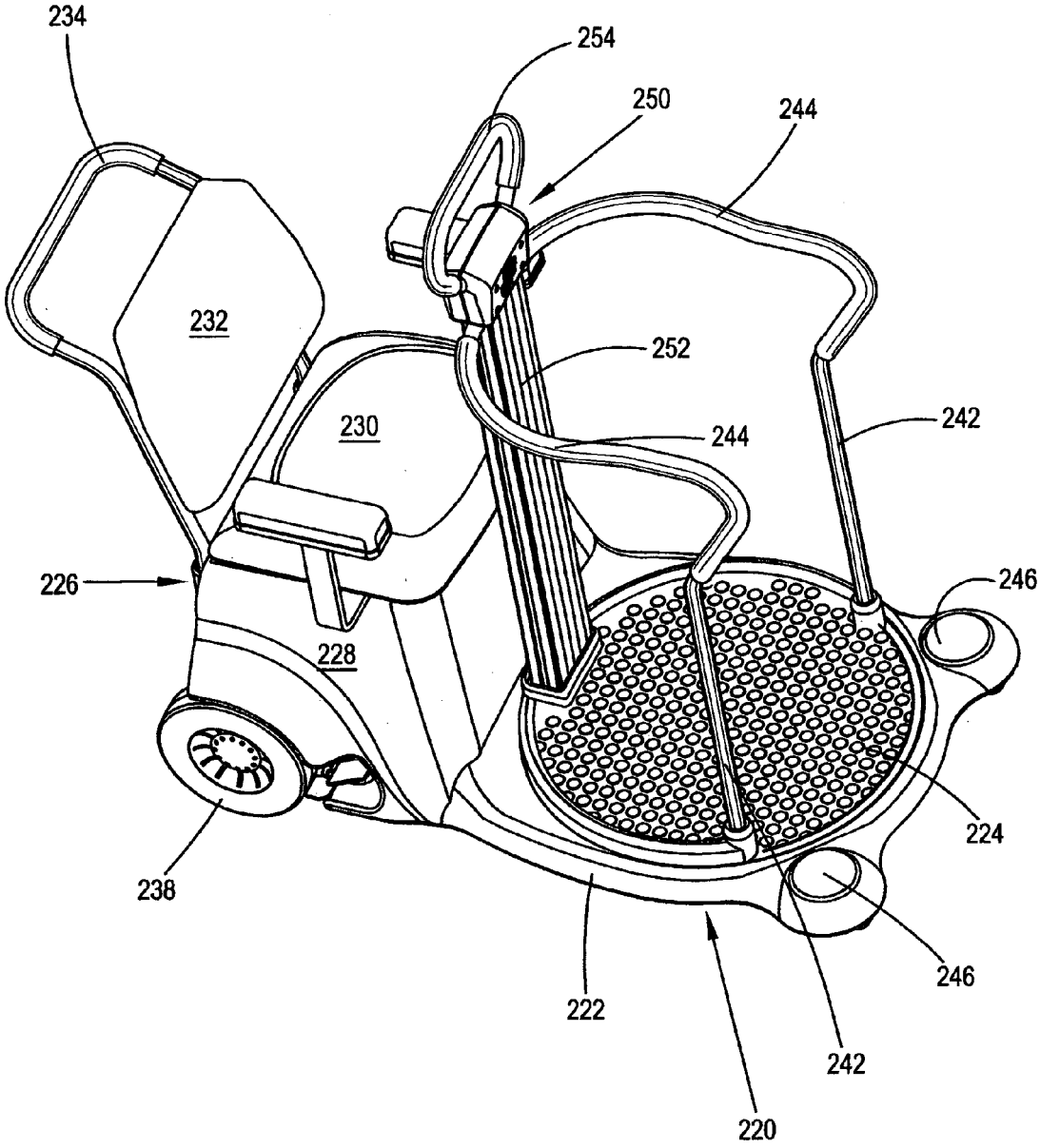
FIG. 25 is a perspective view of a further embodiment with a seat adjacent the rotatable platform and with wheels.
Figure 26:
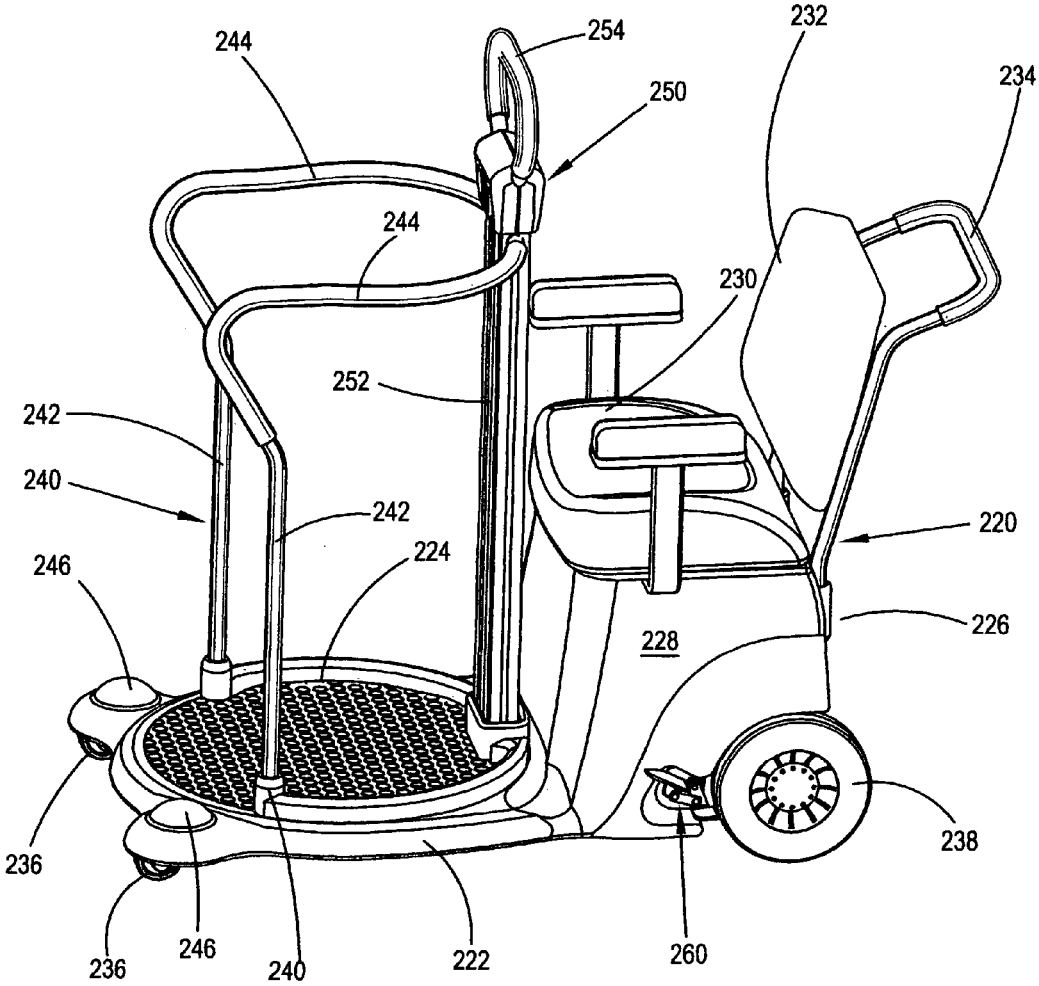
FIG. 26 is a view similar to FIG. 25 looking at the opposite side.
Figure 27:
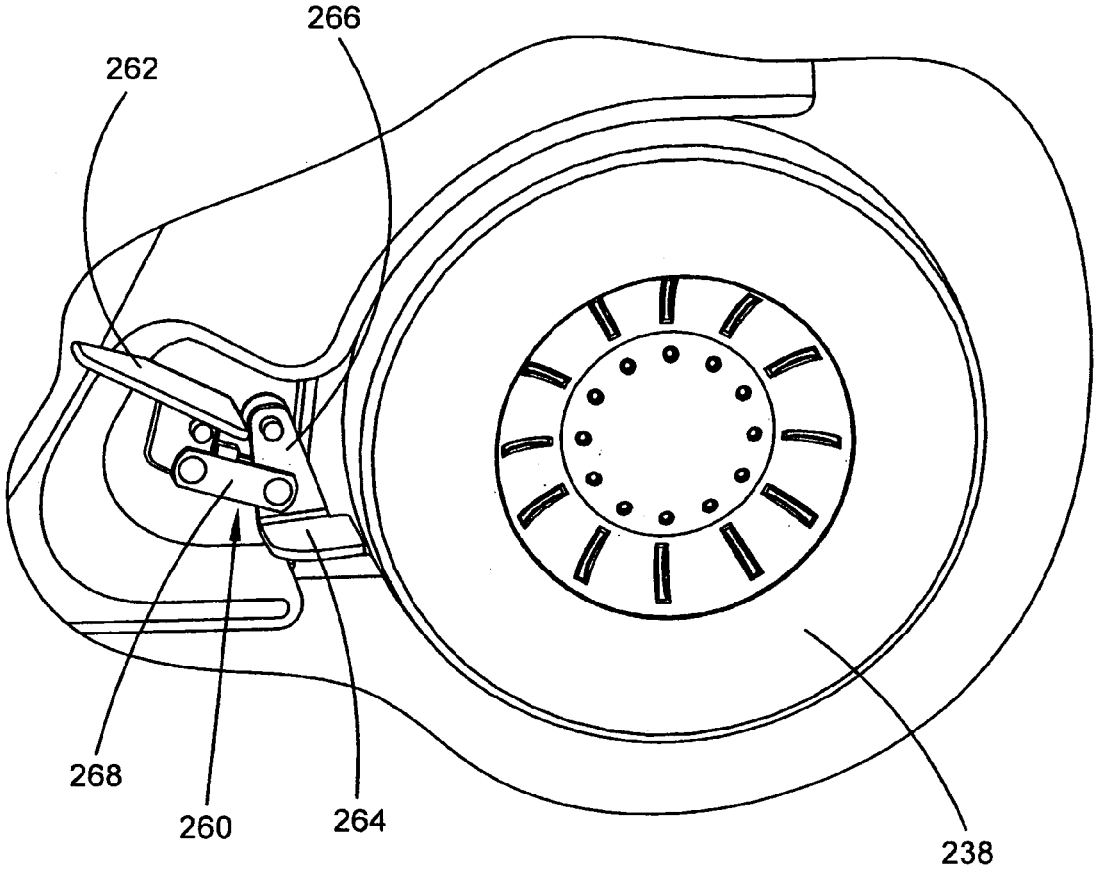
FIG. 27 is an enlarged fragmentary view showing the rear wheel as shown in FIG. 26 and showing a brake assembly therefor.

Referring to FIGS. 25–27, there is shown a modified embodiment of medical assist device 220 having a frame 222 on which is mounted a rotatable platform 224 which is similar to that described in the previous embodiments. More specifically, its rotation is effected by a worm gear which engages gear teeth of a rotatable wheel such as that described with reference to the worm gear 97 engaged to the gear teeth 77 of the rotatable wheel in the embodiment of FIGS. 14 and 15. Other means for effecting the rotation of the rotatable platform 224 could, of course, be utilized.

Also mounted on the frame 222 adjacent the rotatable platform 224 is a seat assembly 226 having a raised platform 228 on which is mounted a seat 230 on which a patient may be seated. The seat assembly 226 also includes a back 232 and a handle 234 for gripping by an attendant when pushing the medical assist device 220.

The frame 222 is mounted on a pair of small front wheels or casters 236 and a pair of larger wheels 238.

Mounted on and extending upwardly from the rotatable platform 224 is a front gripping assembly 250 and a pair of side gripping assemblies 240. The side gripping assemblies 240 each have upwardly extending post portions 242 and gripping bar portions 244 for gripping by a patient standing on the rotatable platform 224. As such the gripping assemblies 240 are positioned on the rotatable platform 224 so that the gripping bar portions 244 are generally parallel to one another and parallel to the rotatable platform 224 with a space therebetween in which the patient may stand. Foam gripping members are positioned on the side gripping bar portions 244. The side gripping assemblies 240 have the gripping bar portions 244 secured to the front gripping assembly 250.

The front gripping assembly 250 has an upstanding panel 252 extending upwardly from the rotatable platform 224 and positioned near the edge or outer periphery thereof. The gripping bars 244 are joined to the upper portion of the panel 252. An upper gripping bar 254 is mounted on the upper end of the panel 252 and may also have foam griping members.

Figure 28:
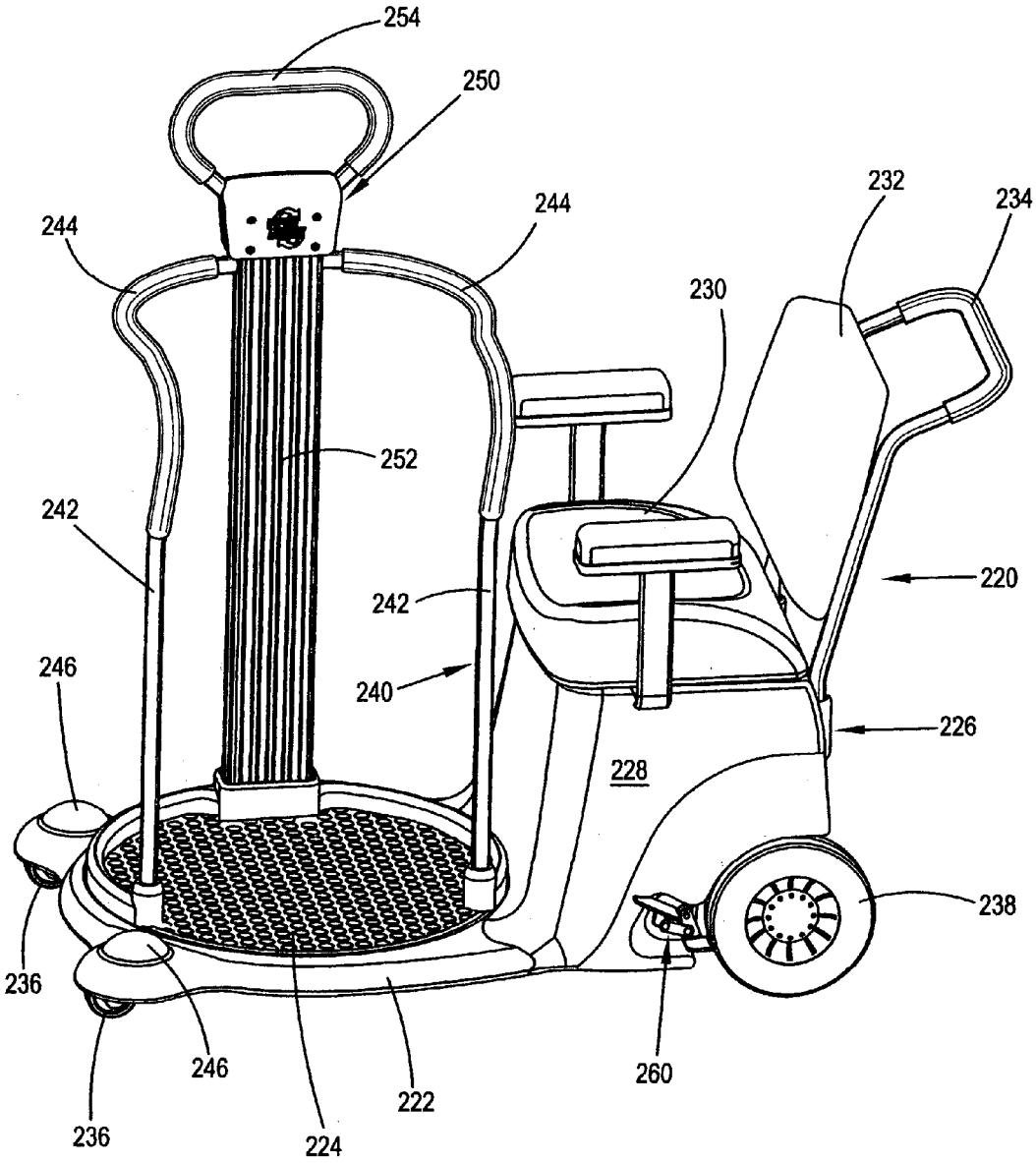
FIGS. 28 and 29 are views similar to FIG. 25 showing the rotatable platform rotated 90° and 180° from the position of FIG. 25.
Figure 29:
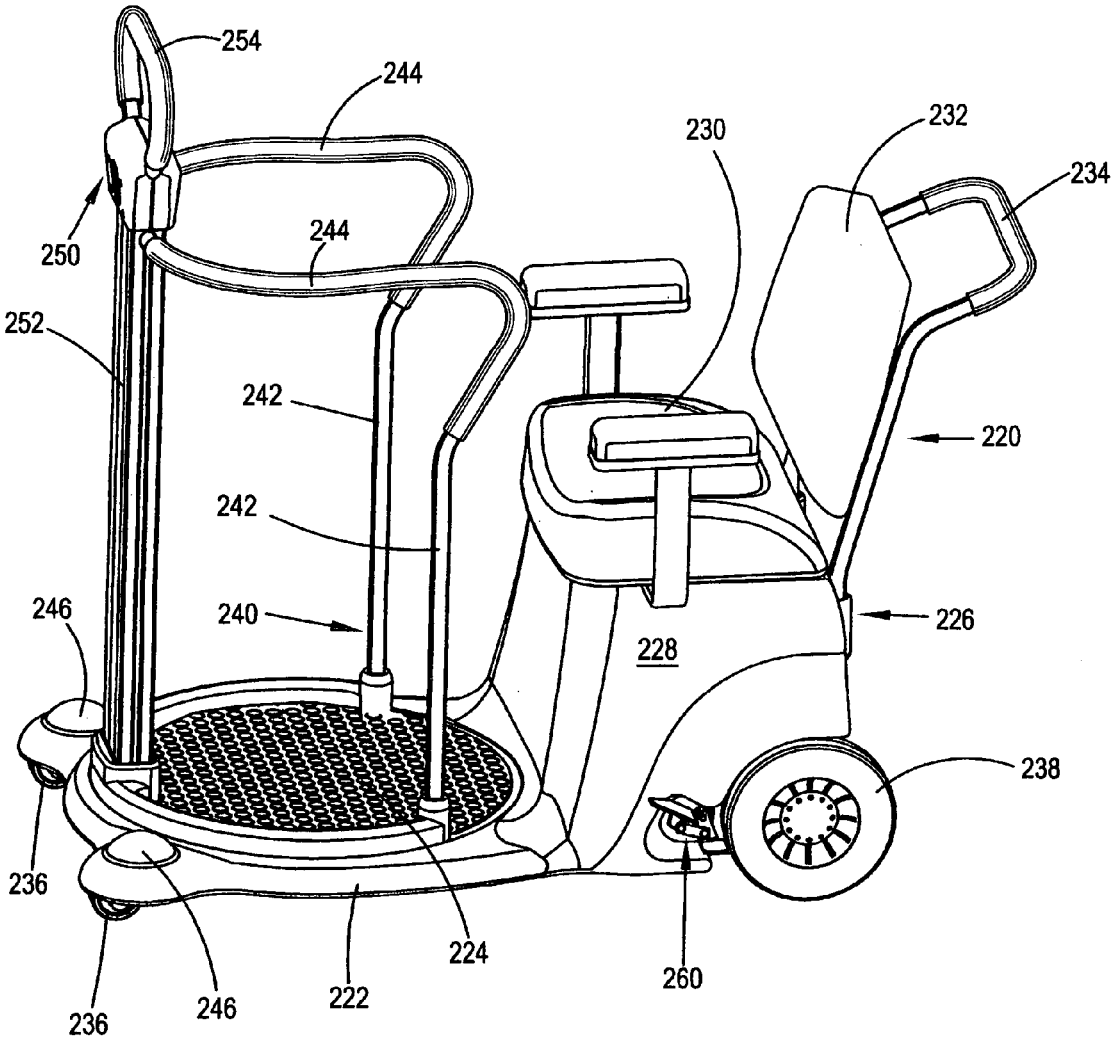

The patient may be seated on the seat 230 when the rotatable platform 224 is positioned with the front gripping assembly 250 on the opposite side of the rotatable platform 224 from the seat assembly 226 as shown in FIG. 29. The patient can then be assisted to a standing position at which time the attendant may actuate the motor to rotate the rotatable platform 224 either clockwise 90° to the position shown in FIG. 28, or 180° to the position shown in FIGS. 25 and 26, or counter–clockwise 90° or 180°.

As can be seen in FIGS. 25 and 26, the frame 222 has a pair of integral upstanding hubs 246 over the casters 236 in spaced relationship therewith. Since the hubs 246 are in a raised position above the rotatable platform 224, it is desirable that the rotatable platform not come to a stop at a rotational position where a patient exiting the medical assist device would be aligned with and possibly trip over one of the hubs 246. Thus, the open space between the side gripping assemblies 240 at the side opposite the front gripping assembly 250 should never be aligned with one of the hubs 246. This is accomplished by programming the controls through use of a magnetic read switch to permit the rotatable platform 224, once actuated for rotation, to stop only when such open space is aligned with the seat assembly 226 or at positions 900 or 1800 from the seat assembly 226. A magnetic read switch such as one sold by Hamlin Electronics, Lake Mills, Wis., under its Model No. 59135-010 is suitable for this purpose. The lower side of the rotatable platform 224 is provided with a magnet at each of the four 900 positions near the outer periphery thereof. The magnetic read switch has a proximity sensor positioned on the frame in a plane lower than the plane of the magnets. When a magnet becomes aligned with the proximity sensor, the switch will be actuated by the magnet and stop rotation of the rotatable platform at the next 90° position. If it is desired to go beyond the 90° position to the 180° position, the attendant simply actuates the controls again.

The controls are also provided with a timer which acts with the switch as a safety device to stop the motor powering the rotation after a predetermined time, for example 15 to 25 seconds, if it had not stopped earlier by the signal from the magnetic reed switch.

Referring to FIGS. 26 and 27, there is provided a brake assembly 260 actuatable by a foot pedal 262 to prevent rotation of the wheel 238 and movement of the medical assist device 220 when loading or unloading a patient to or from the medical assist device 220. The brake assembly 260 includes a wheel engagement member 264 supported on a pivotally mounted arm 266 for movement into and out of engagement with the wheel 238. The foot pedal 262 is also pivotally mounted and has mounted thereon a connector member 268 which is also joined to the pivotally mounted arm 266. Pivotal movement of the foot pedal 262 downwardly will move the connector member 268 to the right as shown in FIG. 27 and cause the pivotally mounted arm 266 to rotate in a counter-clockwise direction carrying the wheel engagement member 264 into engagement with the wheel 238 preventing rotation thereof. Upon release of the foot pedal 262, a spring may be utilized to urge the foot pedal 262 upwardly to its original position thereby moving the wheel engaging member 264 away from the wheel 238. Alternatively, if no spring is used, the operator may simply manually lift the foot pedal 262 to release the wheel engaging member.

In contrast to previous embodiments which utilized an electrical cord to deliver electrical power to the electric motor, the embodiment of FIGS. 25–29 preferably utilizes a battery contained within the seat assembly 226 to deliver power to the motor. The seat assembly 226 preferably contains an electric cord on a retractable reel for charging the battery.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A medical assist device comprising (a) a support platform rotatable about an axis;

(b) a power means for rotating said platform including a first gear member rotatable about said axis with said support platform and a worm gear engageable with said first gear member;

(c) gripping structure mounted on and rotatable with said platform, said gripping structure positioned for gripping by a patient standing thereon;

(d) a seat adjacent said platform, (e) a motor for powering rotation of said worm gear, wherein said worm gear extends from said motor and said motor is mounted for pivotal movement carrying said worm gear toward and away from said first gear member; and (f) a spring yieldingly urging said motor to a position at which said worm gear engages said first gear member.

2. A medical assist device for relocating a patient comprising:

(a) a base;

(b) a wheel mounted on said base and rotatable about an axis, said wheel having gear teeth;

(c) a patient support member positioned above and rotatable about said axis with said wheel;

(d) power means for rotating said wheel including a worm gear engageable with said gear teeth; and (e) gripping structure mounted on and rotatable with said patient support member, said gripping structure positioned for gripping by a patient standing thereon.

3. A medical assist device according to claim 2 further including a seat adjacent said patient support member.

4. A medical assist device according to claim 3 wherein said gripping structure is positioned on said patient support member so as to provide direct access from said patient support member to said seat when said patient support member is in at least one rotatable position relative to said seat.

5. A medical assist device according to claim 2 wherein said patient support member includes a portion extending outwardly beyond said wheel and further including bearings positioned between said base and said outwardly extending portion.

6. A medical assist device according to claim 5 further including a motor for powering rotation of said worm gear, wherein said worm gear extends from said motor and said motor is mounted for pivotal movement carrying said worm gear toward said wheel for engagement with said gear teeth and away from said wheel and further including a spring yieldingly urging said motor to a position at which said worm gear engages said first gear member.

7. A medical assist device according to claim 2 wherein said worm gear is mounted for movement toward said wheel for engagement with said gear teeth and away from said wheel and further including a spring yieldingly urging said worm gear to a position at which said worm gear engages said gear teeth.

8. A medical assist device for relocating a patient comprising:

(a) a base;

(b) a wheel mounted on said base and rotatable about an axis, said wheel having gear teeth;

(c) a patient support member positioned above and rotatable about said axis with said wheel, said patient support member extending radially outwardly beyond said wheel;

(d) bearings positioned between said base and said outwardly extending portion;

(e) power means for rotating said wheel including a worm gear engageable with said gear teeth; and (f) a motor for powering rotation of said worm gear, wherein said worm gear extends from said motor and said motor is mounted for pivotal movement carrying said worm gear toward said wheel for engagement with said gear teeth and away from said wheel and further including a spring yieldingly urging said motor to a position at which said worm gear engages said gear teeth.

9. A medical assist device according to claim 8 further including gripping structure mounted on and rotatable with said patient support member, said gripping structure positioned for gripping by a patient standing thereon.

10. A medical assist device according to claim 8 further including a seat adjacent said patient support member.

* * * * *